US010327573B2

(12) United States Patent
Ali et al.

(10) Patent No.: US 10,327,573 B2
(45) Date of Patent: Jun. 25, 2019

(54) APPARATUS, DEVICE, AND METHODS FOR MIXING SUBSTANCES

(71) Applicant: Titan Mixer Bottle, LLC, Columbus, OH (US)

(72) Inventors: Adan Ali, Columbus, OH (US); Lonie Smith, Columbus, OH (US); Fred Bowman, Columbus, OH (US); Gered Bowman, Columbus, OH (US); Mohamed Rage, Columbus, OH (US)

(73) Assignee: Titan Mixer Bottle, LLC, Columbus, OH (US)

( * ) Notice: Subject to any disclaimer, the term of this patent is extended or adjusted under 35 U.S.C. 154(b) by 0 days.

(21) Appl. No.: 16/114,755

(22) Filed: Aug. 28, 2018

(65) Prior Publication Data

US 2019/0000250 A1 Jan. 3, 2019

Related U.S. Application Data

(63) Continuation of application No. 15/164,863, filed on May 25, 2016, now Pat. No. 10,104,994.

(51) Int. Cl.

| | |
|---|---|
| ***B01F 3/12*** | (2006.01) |
| ***B65D 1/04*** | (2006.01) |
| ***A47G 19/22*** | (2006.01) |
| ***B01F 11/00*** | (2006.01) |
| ***B01F 13/00*** | (2006.01) |

(Continued)

(52) U.S. Cl.

CPC ..... *A47G 19/2272* (2013.01); *A47G 19/2205* (2013.01); *B01F 3/1221* (2013.01); *B01F 11/0054* (2013.01); *B01F 13/0022* (2013.01); *B01F 15/00506* (2013.01); *B01F 15/0223* (2013.01); *B65D 1/04* (2013.01); *B01F 2215/0022* (2013.01)

(58) Field of Classification Search

CPC ..... A47G 19/2205; A47G 19/2272; B01F 11/0054; B01F 13/0022; B01F 15/00506; B01F 15/0223; B01F 2215/0022; B01F 3/1221; B65D 1/04

See application file for complete search history.

(56) References Cited

U.S. PATENT DOCUMENTS 378,752 A * 2/1888 Ader ..... B65D 1/04 215/6

400,547 A * 4/1889 Crafton ..... A47J 43/105 366/243

(Continued)

*Primary Examiner* — Tony G Soohoo

(57) ABSTRACT

The subject matter described herein includes apparatus's and methods for storing and mixing materials such as powders and liquids. The mixing apparatus can comprise an impeller portion configured to rotate downward or upward within the main cup, wherein a movement of the impeller portion downward or upward is capable of mixing the contained set of substances, wherein the impeller portion comprises a set of propeller blades, and wherein the impeller portion is connected to a helical shaft portion comprising a first helical strand and a second helical strand wound uniformly in a parallel spiral configuration. The impeller portion facilitates a distributed mixing of the substances and the propeller blades are capable of removing deposits of the substance around the base of a main cup of the apparatus.

10 Claims, 22 Drawing Sheets

(51) Int. Cl.
*B01F 15/00* (2006.01)
*B01F 15/02* (2006.01)

(56) References Cited

U.S. PATENT DOCUMENTS 475,231 A * 5/1892 Anderson ..... B65D 21/083 220/4.26
815,883 A * 3/1906 Van Blaroom ..... A47G 19/24 215/10
1,068,450 A * 7/1913 Roberts ..... F16D 1/094 366/243
1,237,585 A * 8/1917 Tripke ..... A47J 43/105 30/120.1
1,238,461 A * 8/1917 Tripke ..... A47J 43/105 366/243
1,373,761 A * 4/1921 Rabin ..... A47J 43/105 366/243
1,415,334 A * 5/1922 Gibson ..... A01J 15/06 366/243
1,798,757 A * 3/1931 Roberts ..... A47J 43/105 366/242
2,162,348 A * 6/1939 Hacmac ..... A47J 43/105 222/189.07
2,266,186 A * 12/1941 Fischer ..... A47J 43/105 366/183.1
2,374,092 A * 4/1945 Glaser ..... A47G 19/2205 141/380
2,488,611 A * 11/1949 Stallings ..... A47J 41/0083 206/509
2,726,071 A * 12/1955 Rudolph ..... A47J 43/1081 366/256
2,749,098 A * 6/1956 Johnson ..... A47J 43/105 366/243
2,843,281 A * 7/1958 Gallois ..... A61J 9/00 215/11.1
3,348,716 A * 10/1967 Yuichi ..... B65D 11/04 206/509
3,521,745 A * 7/1970 Schwartzman .... B65D 81/3211 206/222
4,823,946 A * 4/1989 Stoeffler ..... B65D 81/3211 206/221
5,361,918 A * 11/1994 Mason ..... A61J 1/20 215/11.1
5,695,282 A * 12/1997 Hess ..... A47J 43/27 366/256
D415,959 S * 11/1999 Antoine ..... D9/724
6,095,676 A * 8/2000 Kuan ..... B01F 7/26 366/256
6,450,368 B1 * 9/2002 De LaForcade ..... B65D 1/04 206/221
D571,610 S * 6/2008 Bodum ..... D7/397
D655,967 S * 3/2012 Bodum ..... D7/300.1
D665,222 S * 8/2012 Cerasani ..... D7/376
8,402,722 B2 * 3/2013 Buesching ..... B65D 77/0493 206/217
8,534,908 B2 * 9/2013 Rhodes, II ..... A47J 43/1018 222/465.1
9,216,843 B2 * 12/2015 Sorensen ..... B65D 21/0228
D766,029 S * 9/2016 Lin ..... D7/300.1
9,643,141 B2 * 5/2017 Kershaw ..... B01F 13/0022
9,839,888 B2 * 12/2017 Kershaw ..... B01F 13/0022
10,028,604 B2 * 7/2018 Gonzalez ..... A61J 9/0623
2004/0262173 A1 * 12/2004 Buesching ..... B65D 1/04 206/217
2005/0098526 A1 * 5/2005 Catalin ..... B65D 21/0231 215/6
2008/0179334 A1 * 7/2008 Abramson ..... B01F 13/002 220/568
2008/0259723 A1 * 10/2008 Rhodes ..... A47J 43/1018 366/247
2010/0213085 A1 * 8/2010 Belnap ..... A61J 1/2093 206/219
2013/0279287 A1 * 10/2013 Cerasani ..... B65D 47/0885 366/130
2014/0004242 A1 * 1/2014 Lefkovitz ..... A23N 1/003 426/489
2014/0269152 A1 * 9/2014 Venot ..... B01F 7/0055 366/129
2015/0090711 A1 * 4/2015 Peterson ..... A47G 19/2272 220/4.07
2016/0249773 A1 * 9/2016 Van Pelt ..... A47J 43/27 220/592.26
2016/0346746 A1 * 12/2016 Rage ..... B01F 3/1221
2018/0064289 A1 * 3/2018 Bolling ..... B01F 11/0054
2018/0214349 A1 * 8/2018 Mayer ..... A61J 9/001

* cited by examiner

APPARATUS, DEVICE, AND METHODS FOR MIXING SUBSTANCES

PRIORITY CLAIM

This application claims priority to U.S. patent application Ser. No. 15/164,863 filed on May 25, 2016, and entitled "APPARATUS, DEVICE, AND METHODS FOR MIXING SUBSTANCES", which claims priority to U.S. Patent Application No. 62/166,896 titled "MIXER BOTTLE" filed on May 27, 2015. The entirety of the aforementioned applications are incorporated by reference herein.

TECHNICAL FIELD

This disclosure generally relates to devices and methods for containing, mixing and evenly dispersing solid particles with a liquid.

BACKGROUND

Given the advent of health consciousness in many people, there for such people to prioritize healthy eating, exercise, and fitness. As such, people have begun to purchase accessories to accompany such healthy living. For those individuals that have a regular fitness regiment, they often make sure to eat properly prior to exercising and in many instances, such people incorporate protein and vitamin powders into their diets. These powders are often mixed with liquids such as water before consumption and as a convenience the powders and liquids are preferred to be consumed closer to the time a person exercises.

Accordingly, people prefer to store the powder and liquid until the time of consumption and mix the powder and liquid at such time. Various products that claim to facilitate such storage and mixing present numerous problems and fail in their efficacy. For instance, some mixing bottles allege to provide a quality mixing capability by including a bottle housing with a whisking ball located at the bottom. After adding a liquid and powder to the bottle the person is then instructed to shake the bottle causing the whisking ball to move up and down within the bottle. The movement of the whisking ball is alleged to properly mix the liquid and powder together, however, the result is a improperly mixed substance with clumps stuck to the bottle edges and powder that fails to distribute throughout the liquid.

Mixer bottles that claim to provide a mixing capability of liquids and powders present numerous problems. One such problem is the lack of a proper mixing mechanism. In the example of the whisk ball, as the bottle is shaken, the whisk ball merely moves in the same direction as the flow of the liquid, which is ineffective in distributing the powder throughout the liquid mixture. Another problem exists where the bottles lead to clumps that stick to the edges of the bottle and throughout the liquid medium. Furthermore, the object intended to mix the powder and liquid fails to interface with a majority or all of the liquid. For instance, the whisk ball is smaller than the bottle cavity in order to freely move throughout the bottle cavity, however, the size differential results in the whisk ball failing to interface with much of the liquid including the liquid within the cavity spaces that are unoccupied by the whisk ball.

As such, there are numerous problems and inefficiencies associated with existing mixer bottles. Thus, new devices, systems, and methods are required to overcome such issues related to the storage and mixing of substances.

SUMMARY

The following presents a simplified summary of the disclosure in order to provide a basic understanding of some aspects of the disclosure. This summary is not an extensive of the disclosure. It is intended to neither identify key or critical elements of the disclosure nor delineate any scope of the particular aspects of the disclosure, or any scope of the claims. Its sole purpose is to present some concepts of the specification in a simplified form as a prelude to the more detailed description that is presented in this disclosure.

In accordance with an aspect, an apparatus is disclosed comprising a main cup housing portion comprising main cup base and a main cup top end, wherein the main cup housing portion is configured to contain a set of substances at a main cup opening located at the main cup top end. Also disclosed is a receptacle portion configured to store a first subset of substances of the set of substances, wherein the receptacle portion is capable of interlocking to the main cup base, and wherein the receptacle portion comprises a funnel lid portion at a receptacle portion top end. Furthermore, disclosed is an impeller portion configured to rotate downward or upward within the main cup housing portion, wherein a movement of the impeller portion downward or upward is capable of mixing the contained set of substances, wherein the impeller portion comprises a set of propeller blades, and wherein the impeller portion is connected to a helical shaft portion comprising a first helical strand and a second helical strand wound uniformly in a parallel spiral configuration. In another aspect, disclosed is a housing lid portion capable of interlocking to the main cup top to enclose the main cup opening.

In another aspect, disclosed is a method comprising detaching a funnel lid portion of a receptacle portion of an apparatus using an unscrewing mechanism; accessing a first powder substance stored within a receptacle cavity of the receptacle portion of the apparatus; attaching a funnel element of the detached funnel lid portion to a drinking lip portion of the apparatus, wherein the drinking lip portion comprises a drinking opening connected to a main cup housing; and pouring the first substance stored within the receptacle cavity into the funnel element, wherein the funnel element transports the first powder substance into the main cup housing storing a first liquid substance.

The following description and the annexed drawings set forth in detail certain illustrative aspects of this disclosure. These aspects are indicative, however, of but a few of the various ways in which the principles of this disclosure may be employed. This disclosure intended to include all such aspects and their equivalents. Other advantages and distinctive features of this disclosure will become apparent from the following detailed description of this disclosure when considered in conjunction with the drawings.

BRIEF DESCRIPTION OF THE DRAWINGS

Numerous aspects, embodiments, objects and advantages of the present invention will be apparent upon consideration of the following detailed description, taken in conjunction with the accompanying drawings, in which like reference characters refer to like parts throughout, and in which.

DETAILED DESCRIPTION

Figure 1:
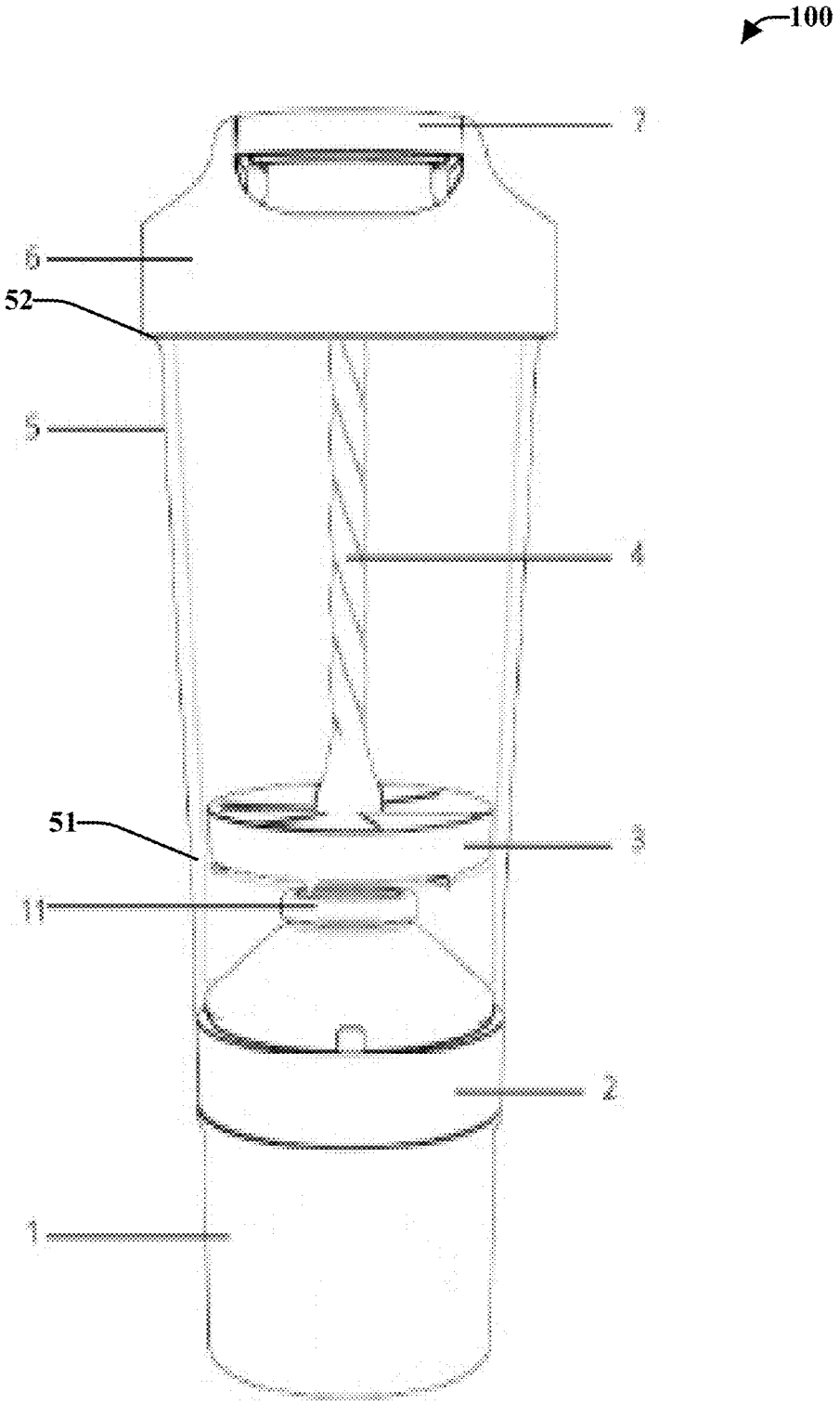
FIG. 1 illustrates a non-limiting high-level diagram of an example apparatus configured to store and mix substances in accordance with the subject application.

The innovation is described with reference to the drawings, wherein like reference numerals are used to refer to like elements throughout. In the following description, for purposes of explanation, numerous specific details are set forth in order to provide a thorough understanding of this innovation. It may be evident, however, that the innovation can be practiced without these specific details. In other instances, well-known structures and components are shown in block diagram form in order to facilitate describing the innovation.

By way of introduction, the subject disclosure is related to apparatuses and methods for storing and mixing substances. In an aspect, an apparatus is provided the facilitates the containment of substances such as liquids, powders, and solids, as well as the mixing of such substances (e.g., mixing of liquids and powders) in an efficacious manner. The storing of liquids and powders can be helpful for a variety of purposes. For instance, a person may desire to store baby formula powder (e.g., in a receptacle portion of the apparatus) and water (e.g. in a main cup housing portion) when travelling outside the house with an infant or toddler. In another instance, a person may desire to store protein powder (e.g., in a receptacle portion) and water (e.g., in a main cup housing portion) for consumption before, during or after exercising.

In a non-limiting embodiment, the apparatus can comprise a main cup housing portion comprising main cup base and a main cup top end, wherein the main cup housing portion is configured to contain a set of substances at a main cup opening located at the main cup top end. In an aspect, the apparatus also comprises a receptacle portion configured to store a first subset of substances of the set of substances, wherein the receptacle portion is capable of interlocking to the main cup base, and wherein the receptacle portion comprises a funnel lid portion at a receptacle portion top end.

Furthermore, in an aspect, an impeller portion is configured to rotate downward or upward within the main cup using a pump handle and helical shaft connected to the impeller. The movement of the impeller portion downward or upward can cause the mixing of a set of substances contained within the main cup. For instance, the protein powder stored in a receptacle portion of the apparatus can be poured into the main cup (e.g., using a funnel that can detach from the top of the receptacle portion). The main cup can contain water such that the protein powder is delivered into the water. Subsequently, the impeller portion can be rotated and pumped up and down throughout the main cup using the pump handle to drive the pumping. The pumping a rotation of the impeller portion can cause the protein powder to mix throughout the water to achieve an efficacious dispersion of the protein powder throughout the liquid.

Furthermore, the impeller portion comprises a set of propeller blades and can be connected to a helical shaft portion comprising a first helical strand and a second helical strand wound uniformly in a parallel spiral configuration. Thus the propeller blades can facilitate the efficacious mixing of the protein powder and liquid. Also, the helical shaft, which comprises the two helical strands twisted around one another, facilitates the rotational spinning of the impeller portion such that the constant upward, downward and rotating of the impeller throughout the main cup causes the churning of the liquid and powder in such a way to accomplish effective mixing. Also, in an aspect, a housing lid portion is capable of interlocking to the main cup top to enclose the main cup opening. The housing lid portion can provide a person with drinking access to the contents within the main cup and can also plug closed a drinking lip to prevent the contents within the main cup from spilling. Furthermore, a clip handle located on the lid portion can move along a hinge to facilitate carrying the apparatus from one location to another by a user.

The above-outlined embodiments are now described in more detail with reference to the drawings, wherein like reference numerals are used to refer to like elements throughout. In the following description, for purposes of explanation, numerous specific details are set forth in order to provide a thorough understanding of the embodiments. It may be evident, however, that the embodiments can be practiced without these specific details. In other instances, well-known structures, apparatuses, and methods are shown in block diagram form in order to facilitate describing the embodiments.

While in some illustrations the various components are illustrated as separate components, it is noted that the various components can be comprised of one or more other components. Further, it is noted that the embodiments can comprise additional components not shown for sake of brevity. Additionally, various components described herein may be assembled to form one apparatus.

Referring now to FIG. 1, presented is a non-limiting example embodiment of mixer bottle apparatus 100 configured to store and mix substances. The various components of apparatus 100 and apparatus 100 elements can be connected via screwing, snapping, clasping, clipping, and other linking mechanisms. In an aspect, illustrated is a main cup housing portion 5 comprising main cup base 51 and a main cup top end 52, wherein the main cup housing portion 5 is configured to contain a set of substances at a main cup opening 53 located at the main cup top end 52.

In an aspect, the main cup housing portion 5 is a cup-like container capable of receiving liquids, powders and solids for containment. Within the housing portion 5 is where the mixing of substances take place such as a liquid and powder. The top of the housing portion referred to as the main cup top end 52 is capable of connecting (e.g., via screwing) to the housing lid portion 6. In an aspect, the housing portion 5 is capable of containing the helical shaft portion 4 and the impeller portion 3 to facilitate effective mixing of the substances contained within housing portion 5. Furthermore, in an aspect, the main cup housing portion 5 is the central component of the mixer bottle 100. In an aspect, at the main cup base 51, the funnel lid portion 2 connects (e.g., via a screwing mechanism) and is capable of detaching as well from the main cup portion 5.

In another aspect, apparatus 100A also comprises a receptacle portion 1 configured to store a first subset of substances of the set of substances, wherein the receptacle portion 1 is capable of interlocking to the main cup base 51, and wherein the receptacle portion 1 comprises a funnel lid portion 2 at a receptacle portion top end 54. The receptacle portion 1 comprises a compartment capable of housing a first substance, such as a powder, liquid, or solid (e.g., protein powder, baby formula, chia seeds, etc.). The compartment can be detached in order to access the substance and pouring such substance into the main cup housing portion 5 for mixing.

In another aspect, the apparatus 100 comprises an impeller portion 3 configured to rotate downward or upward within the main cup housing portion 5, wherein a movement of the impeller portion 3 downward or upward is capable of mixing the contained set of substances, wherein the impeller portion 3 comprises a set of propeller blades, and wherein the impeller portion 3 is connected to a helical shaft portion 4 comprising a first helical strand and a second helical strand wound uniformly in a parallel spiral configuration. In an aspect, the impeller portion 3 is designed to rotate as it is pumped upward and downward through the main cup housing portion 5.

The upward and downward rotating movement facilitates the mixing of the substances (e.g., powder and liquid) within the main cup housing portion 5. Thus the mixing of the substances occurs in a uniform manner such that the composition of the mixing substance evenly disperses the powder throughout the liquid. The impeller portion 3 design includes numerous propeller blades built into the impeller, where each propeller is slanted at an angle which results in a productive mixing ability. Also, each blade overhangs from the lower rim of the impeller circle such that the overhanging blades (e.g., overhand region 24) can dislodge any built up material that accumulates at the main cup base or edges of the main cup housing portion 5.

The overhanging propeller blades (e.g., overhand region 24) act as a gripping tool where the rotation of the impeller portion 3 combined with the narrow knife-like nature of the propeller blade effectively removes built up debris and/or clumps of substances at the main cup base 51. In yet another aspect, the impeller portion 3 is connected to a helical shaft portion 4. In an aspect, the helical shaft portion 4 spirals as it is pumped up and down through the housing lid portion 6 to facilitate the rotation of the impeller portion 3. In yet another aspect, the housing lid portion 6 is capable of interlocking to the main cup top end 52 to enclose the main cup opening 53. Also, the housing lid portion 6 further comprises a drinking lid portion 7 and a pump handle (comprising a right handle half 10 and a left handle half 9). The drinking lid portion 7 facilitates the access (e.g., drinking through the lid) to the mixed substances within the main cup portion 5. Also, the pump handle is attached to the helical shaft portion 4 and can be used to insert and retract the helical shaft portion 4 in and out of the main cup housing portion 5.

In an aspect, apparatus 100A can be depicted from a side view perspective. The apparatus 100A from a side view perspective can allow for viewing of carrying clip portion 8, and pump handle 10. In an aspect, receptacle portion 1 is detachable from main cup housing portion 5, funnel lid portion 2 is detachable from receptacle portion 1, housing lid portion 6 is detachable from housing portion 5, and drinking lid portion 7 is accessible through a lid opening 34 that can be opened and closed. In another aspect, the carrying clip portion 8 is attached to the housing lid portion 6 and is capable of being used for carrying (e.g., user can carry apparatus 100 with a finger slung through the clip hole formed by carrying clip portion 8 and the housing lid portion 6) the apparatus.

Figure 2:
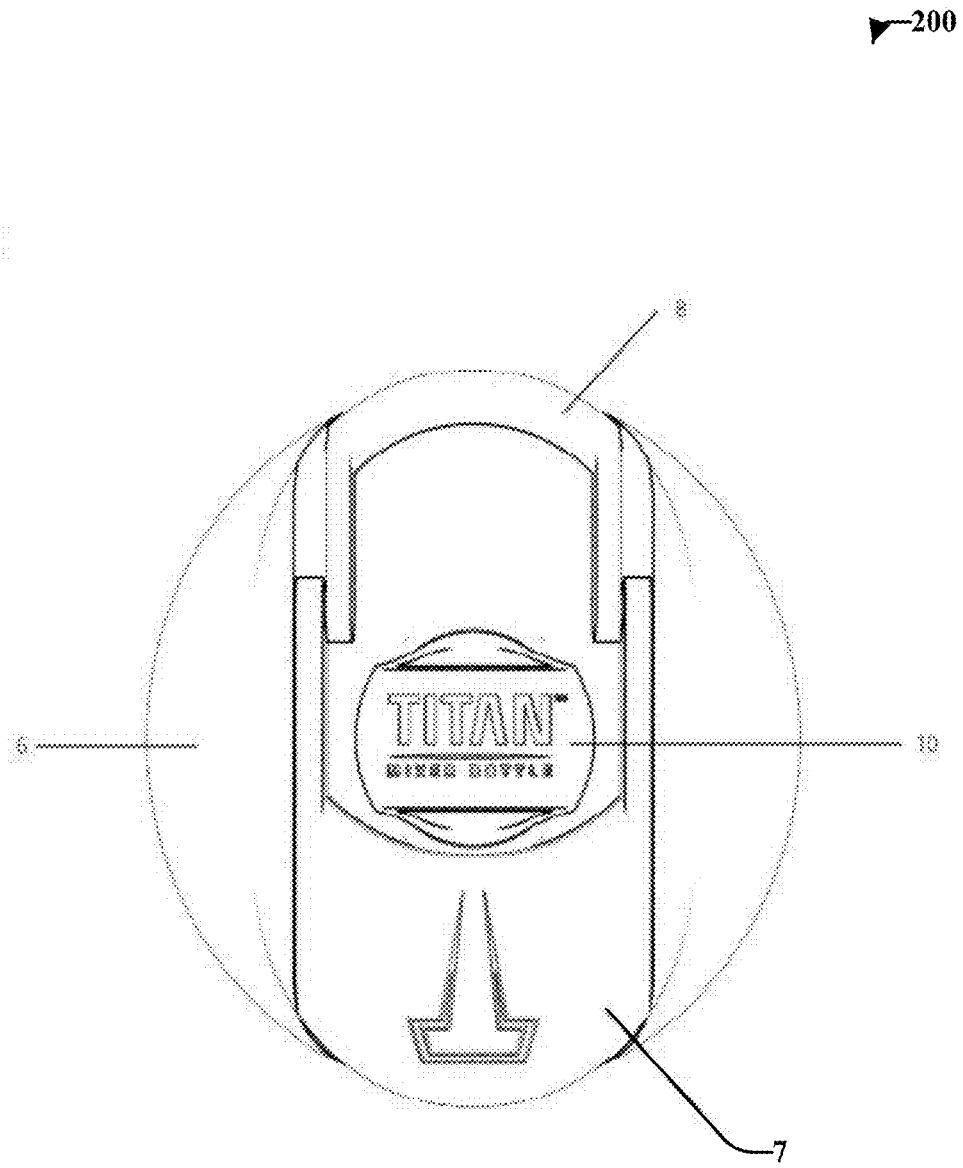
FIG. 2 illustrates a non-limiting high-level diagram of a top view of an example housing lid portion of an example apparatus in accordance with the subject application.

Turning now to FIG. 2, illustrated is a non-limiting aspect of apparatus 200 in accordance with various aspects and implementations of this disclosure. In an aspect, apparatus 200 illustrates a top view of housing lid portion 6. In an aspect, the housing lid portion 6 further comprises a drinking lid portion 7, a carrying clip portion 8, and a pump handle 10, wherein the drinking lid portion 7 is capable of snapping into a lid opening 11 within the drinking lid portion 6, wherein the carrying clip portion 8 is capable of rotating within a first ring hinge (e.g., left housing lid hinge hole 35) and a second ring hinge (e.g., right housing lid hinge hole 36) corresponding to the carrying clip portion 8, and wherein the pump handle 10 comprises a first handle half 9 and a second handle half 10 snapped around a top round peg portion 27 of the helical shaft portion 4.

The housing lid portion 6 is capable of providing a roof to main cup housing portion 5. As such, substances and other contents within the main cup housing portion 5 can be contained and are inhibited from spilling out of the top opening of the main cup housing portion 5. The housing lid portion 6 is detachable from the main cup housing portion 5 by a screwing and unscrewing mechanism. Furthermore, the lid opening 34 is capable of opening and closing via a snap mechanism such that a user can easily drink the contents within the main cup housing portion 5 by unsnapping the drinking lid to the lid opening 34 and drinking. In yet another aspect, the pump handle 10 is accessible from the housing lid portion 6. The pump handle 10 comprises two pieces interlocked together around a top round peg portion 27 of the helical shaft portion 4.

In an aspect, the first handle half 9 of the pump handle 10 and the second handle half 15 of the pump handle snap together to create a fully formed handle that facilitates the upward and downward pumping of the helical shaft portion 27 and the impeller portion 3. Furthermore, in an aspect, the round peg portion 27 is an extension of the helical shaft portion 4 such that the helical shaft portion 4 terminates at its top side in a spherical peg. The bulbous portion of the spherical peg of top round peg portion 27 sits inside a cavity created by the snapping together of the pump handle and the narrower neck region of the top round peg portion 27 also sits inside a narrower portion of the cavity. As such, the top round peg portion 27 is captured within the cavity because the bulbous peg portion cannot squeeze through the narrower cavity portion of the pump handle. Thus the helical shaft portion 4 can hang from the pump handle 10 and spin freely within the pump handle cavity (e.g., first peg cast 30 and second peg cast 31).

For instance, in an aspect, the first handle half 9 and second handle half 10, by snapping around the round peg portion 27 of the helical shaft portion 4, encases the round peg portion 27 but allows it to freely spin within the pump handle encasement cavity (e.g., first peg cast 30 and second peg cast 31) formed by the first handle half 9 and the second handle half 10. Furthermore, in an aspect, the housing lid portion 6 comprises an opening with a tracking that receives the helical shaft portion 4. The grooves of the tracking within the opening (e.g., helical groove cavity 44) of the housing lid portion 6 cause the helical shaft portion 4 to rotate, which in turn causes the round peg portion 27 attached to the helical shaft portion 4 to rotate within the peg handle encasement cavity (e.g., first peg cast 30 and second peg cast 31). As such, the impeller portion 3 attached to the helical shaft portion 4 also rotates as it moves upward and downward through the main cup housing portion 5. This mechanism facilitates the even mixing of substances within the main cup housing portion 5 and the pump handle allows a user to control the up and down motion of the impeller portion 3 by pulling and pushing the pump handle 10.

Also illustrated is carrying clip portion 8 which is capable of rotation on its hinges. A user can slide a finger through carrying clip portion 8 to facilitate carrying apparatus 200 to various locations. Furthermore, in an aspect, drinking lid portion 7 is snapable and can be opened and closed. Furthermore, lid opening 11 is capable of receiving a funnel spout of funnel lid portion 2 to facilitate easy pouring of substances (e.g., powders, solids, or liquids) into the main cup housing portion 5.

Figure 3:
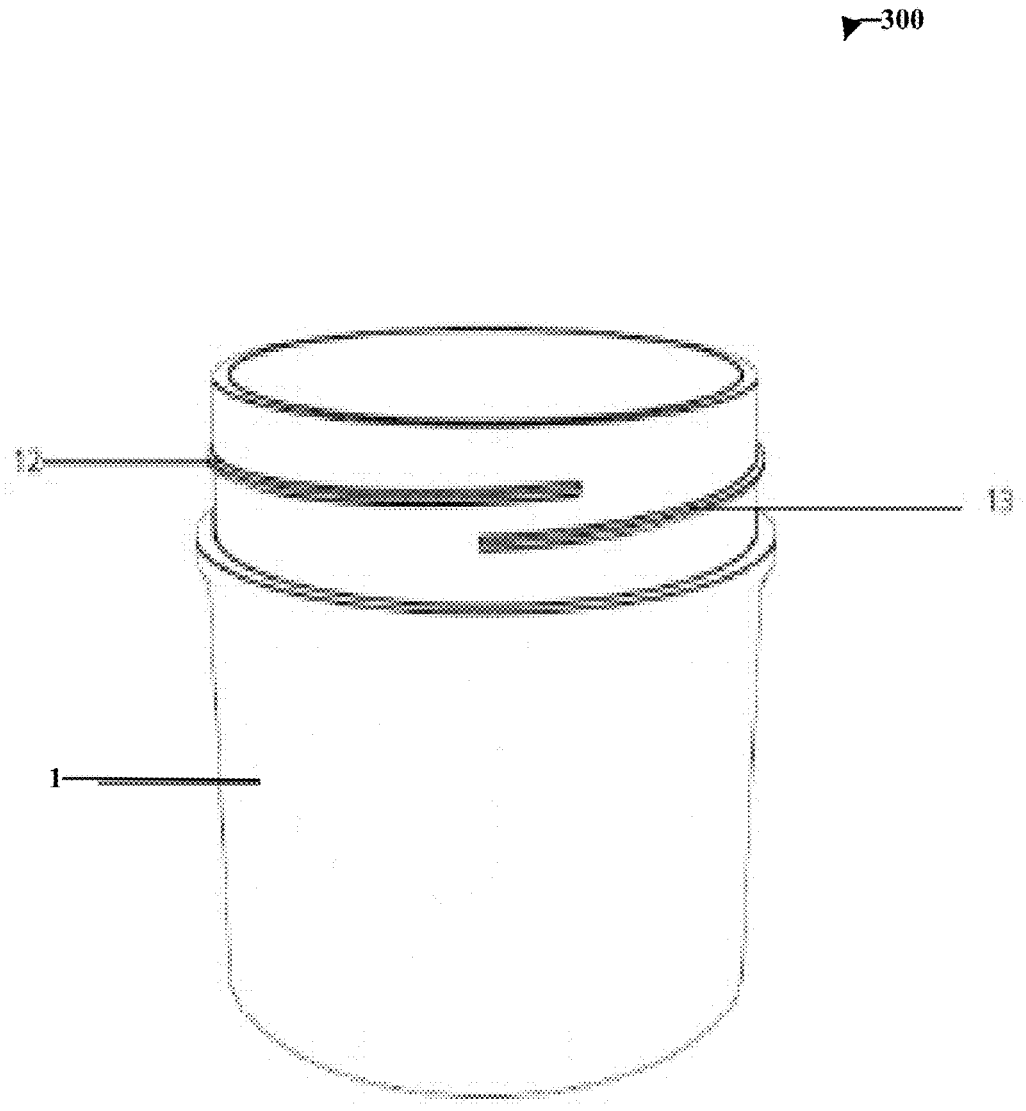
FIG. 3 illustrates a non-limiting high-level diagram of a bottom receptacle portion of an example apparatus configured to store substances in accordance with the subject application.

Turning now to FIG. 3, illustrated is a non-limiting aspect of apparatus 300 in accordance with various aspects and implementations of this disclosure. In an aspect, illustrated is receptacle portion 1 that further comprises a first receptacle screw threading 12 and a second receptacle screw threading 13 that circumscribe the receptacle portion top end 54. In an aspect, receptacle portion 1 can screw onto and off of the base of the main cup housing portion 5. Furthermore, receptacle portion 1 can store substances within its cavity. In another aspect, receptacle portion 1 comprises a first receptacle screw threading 12 that circumscribes the top end of the receptacle opening and a second receptacle screw threading 13 that circumscribe the receptacle portion top end 54 opening. The first receptacle screw threading 12 and second receptacle screw threading 13 facilitate the screwing and unscrewing capability of the receptacle portion 1 to the main cup base 51. In a non-limiting embodiment, the threading can resemble grooves or protrusions circumscribing the main cup base 51.

Turning now to FIG. 3B, illustrated is a non-limiting aspect of apparatus 300B in accordance with various aspects and implementations of this disclosure. In an aspect, illustrated is a side view of receptacle portion 1. Also illustrated is a side view of second receptacle screw threading 13. The screw threading circumscribes the receptacle portion top end 54 outer opening of receptacle portion 1 and includes an angled circumscription around the opening. For instance, the threading circumscribes the outer opening of receptacle portion 1 starting at location 1 with coordinates longitude A and latitude X on the outer opening and snakes around the outer edge ending at location B and latitude Y, where A, B, X, and Y are different numbers to indicate different coordinates along the outer opening. As such, the threading can snake around the outer edge opening starting at a higher point on the outer edge and ending at a lower point along the outer edge.

Turning now to FIG. 3C, illustrated is a non-limiting aspect of apparatus 300C in accordance with various aspects and implementations of this disclosure. In an aspect, illustrated is a top view of receptacle portion 1. Also illustrated are first receptacle screw threading 12 and second receptacle screw threading 13. In a non-limiting example embodiment, first receptacle screw threading 12 and second receptacle screw threading 13 do not overlap in its circumscription of the outer opening of receptacle portion 1.

Figure 4:
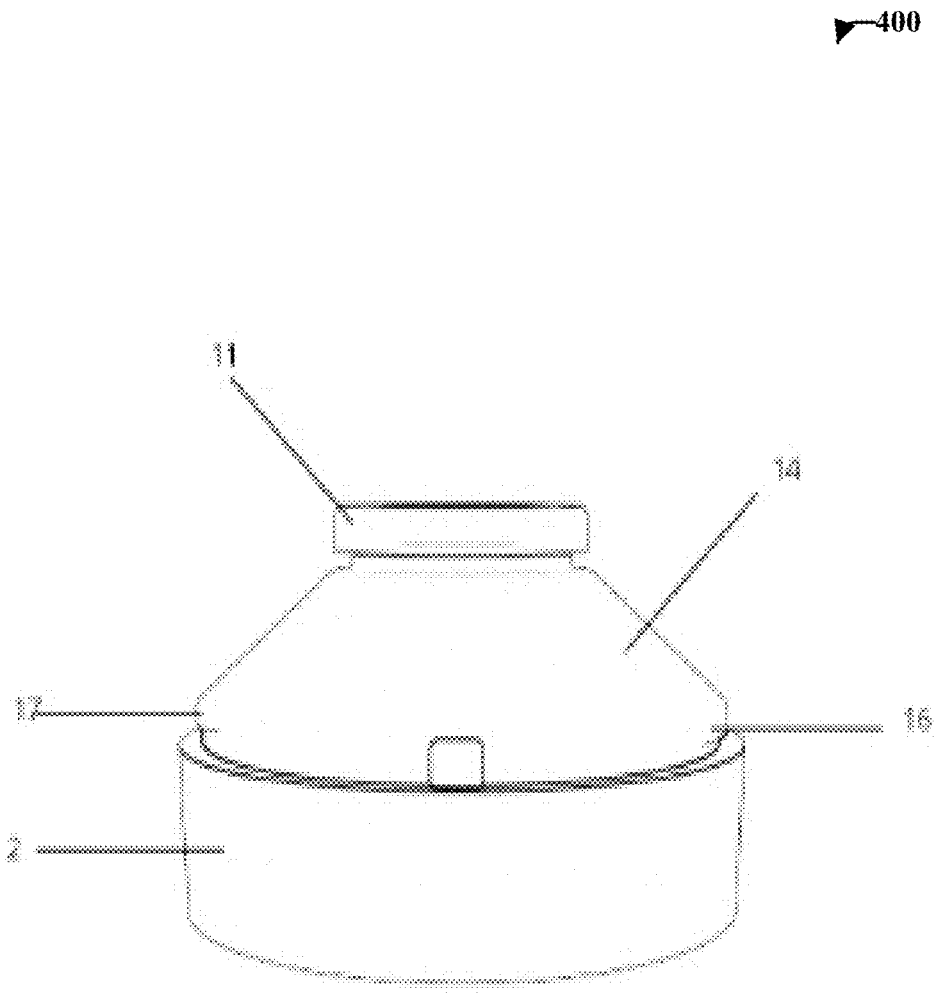
FIG. 4 illustrates a non-limiting high-level diagram of a funnel lid portion of an example apparatus in accordance with the subject application.

Turning now to FIG. 4, illustrated is a non-limiting aspect of apparatus 400 in accordance with various aspects and implementations of this disclosure. In an aspect, illustrated is a side view of funnel lid portion 2. In another aspect, the funnel lid portion 2 further comprises a gradient funnel wall 14 connected to a funnel spout 11 at a top funnel wall end and connected to a cylindrical base at a bottom funnel wall, wherein the gradient funnel wall 14 comprises a first funnel tab 17 and a second funnel tab 16 capable of interlocking with the main cup base, and wherein the funnel spout 11 is configured to fit into the lid opening 34.

In an aspect, the funnel lid portion 2 is capable of acting as a lid for the receptacle portion 1 such that the funnel lid portion 2 can screw on or off of the top of the receptacle portion 1. The funnel lid portion 2 includes a funnel spout 11 protruding from the gradient funnel wall 14 of the funnel lid portion 2. The funnel spout 11 is capable of fitting into the lid opening 34 to generate a funnel capable of transporting substances into the main housing cup portion 5 without making a mess or spilling any of the substance. In another aspect, the gradient funnel wall 14 is a sloping wall attached to the funnel spout 11. The funnel lid portion 2 can connect at its base to receptacle portion 1 and can connect at the top portion to the main cup housing portion 5 via threading that allows for screwing to each respective portion.

In an aspect, the first funnel tab 17 and the second funnel tab 16 are threading that facilitates the screwing of the funnel lid portion 2 to the main cup housing portion 5. Furthermore, also illustrated are the gradient funnel wall 14 and the funnel spout 11. The gradient funnel wall 14 can slope downward from the funnel spout 15 until reaching the base of the funnel lid portion 2 and then attach at the base.

Figure 5A:
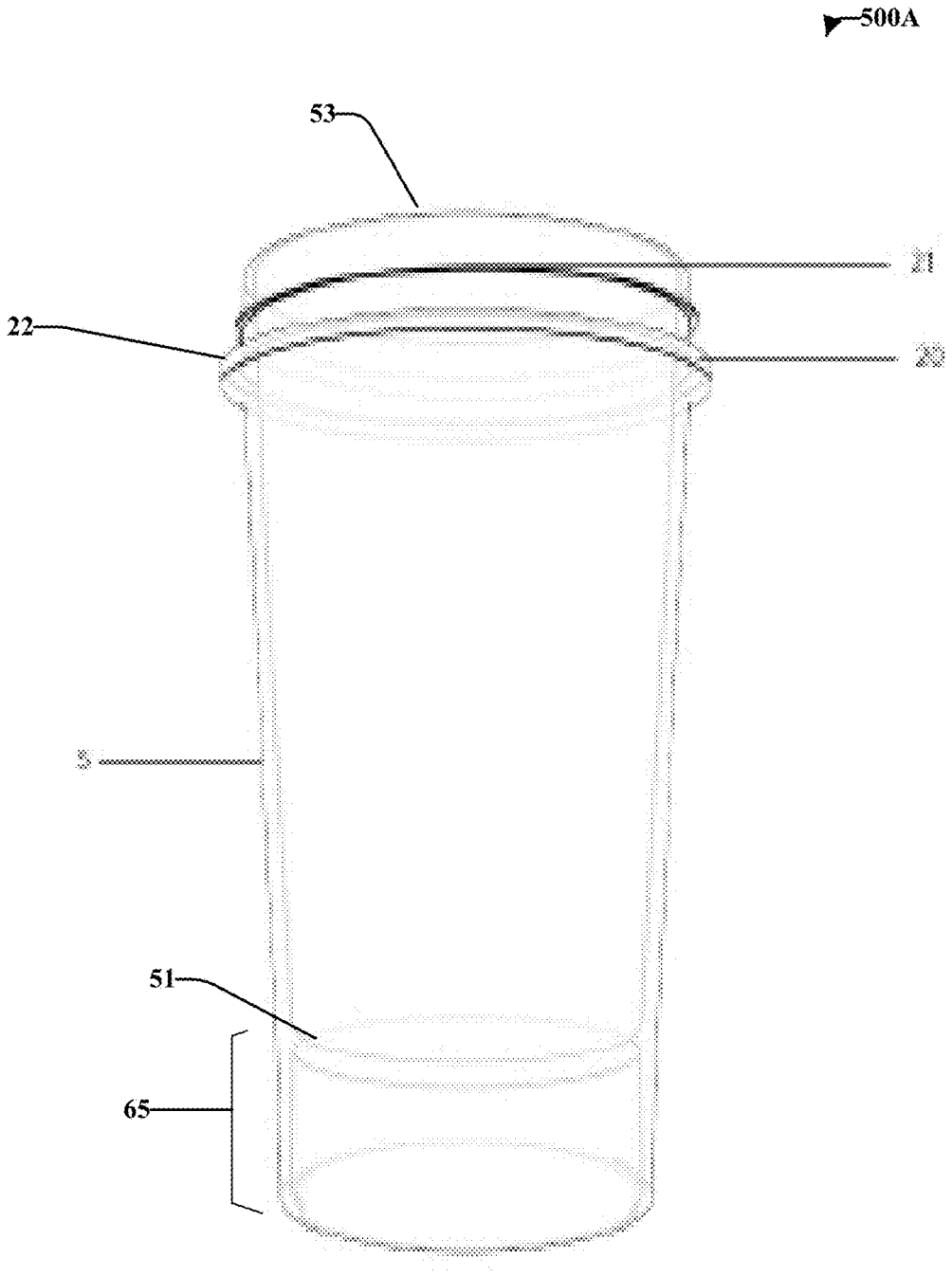
FIG. 5A illustrates a non-limiting high-level diagram of a side view of a main housing cup portion of an example apparatus in accordance with the subject application.

Turning now to FIG. 5A, illustrated is a non-limiting aspect of apparatus 500A in accordance with various aspects and implementations of this disclosure. In an aspect, the main cup housing portion 5 further comprises a main cup lip portion 22, a main cup threading (first cup threading 20, second cup threading 21, etc.), an overhanging cylindrical wall portion 65, a left receiving notch, and a right receiving notch, wherein the main cup lip portion 22 is located near the main cup top end below the main cup threading that circumscribes the main cup above the main cup lip portion 22, wherein the overhanging cylindrical wall portion 65 comprises the left receiving notch 18 and the right receiving notch 19 on a bottom rim of the cylindrical wall portion, and wherein the left receiving notch 18 and the right receiving notch 19 are configured to interlock with the first funnel tab 17.

In an aspect, the main cup lip portion 22 is an extension of the main cup housing portion 5 and extends beyond the upper portion of the main cup housing portion 5 in order to form a ledge. Furthermore, in an aspect, the first cup threading 20 and the second cup threading 21 circumscribe the upper portion of the main cup thus facilitating a screwing of the housing lid portion 6 to the main cup housing portion 5. The left receiving notch 18 and the right receiving notch 19 are also grooved threading that circumscribe the lower portion of the main cup housing portion 5 therefore facilitating the screwing on or off of the receptacle portion 1 to the main cup housing portion 5. In another non-limiting embodiment, instead of threading, apparatus 500A can employ tabs to facilitate interlocking of the receptacle portion 1 and the housing lid portion 6 to the main cup housing portion 5 respectively.

Figure 5B:
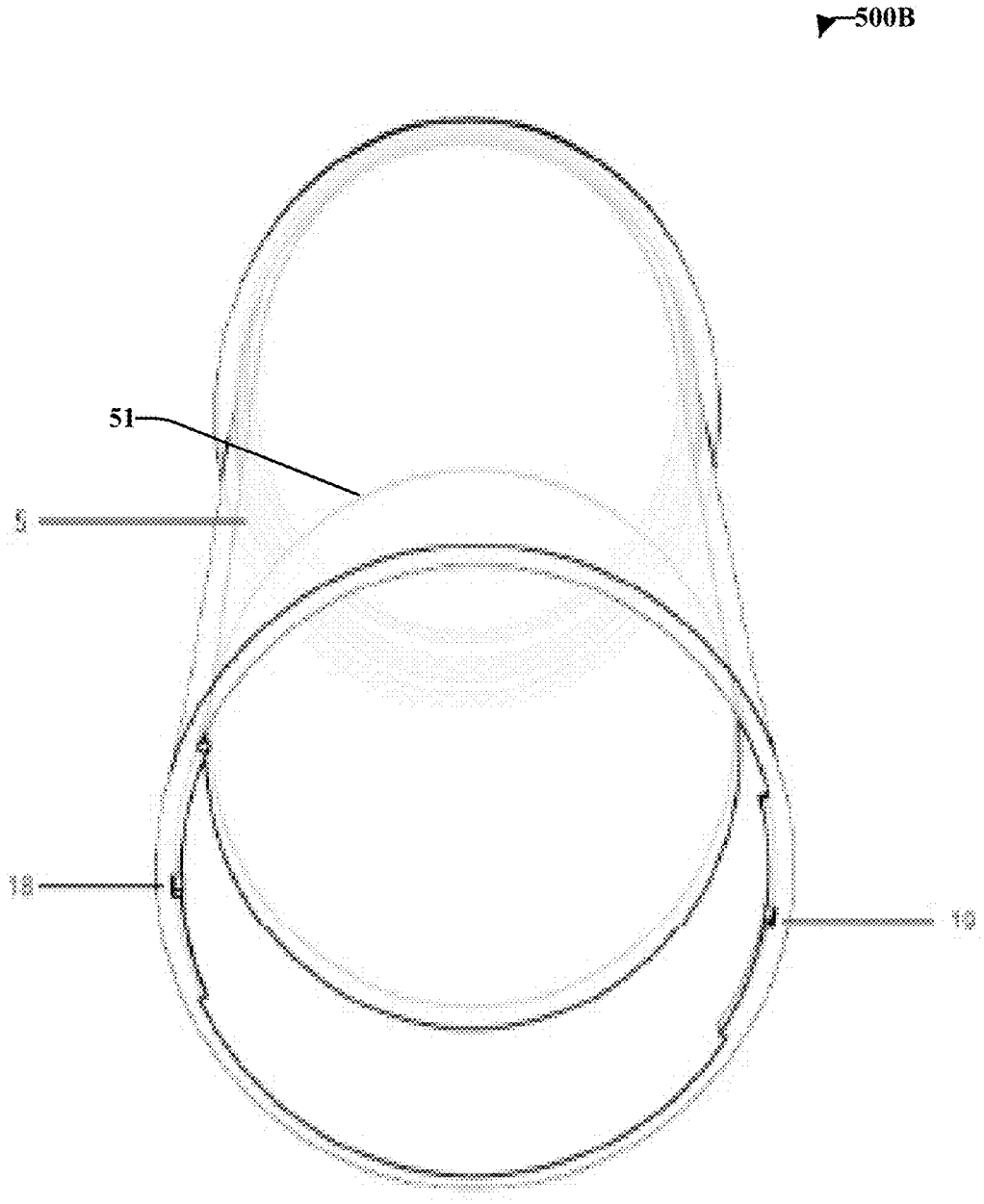
FIG. 5B illustrates a non-limiting high-level diagram of a bottom view of a main housing cup portion of an example apparatus in accordance with the subject application.

Turning now to FIG. 5B, illustrated is a non-limiting aspect of apparatus 500B in accordance with various aspects and implementations of this disclosure. In an aspect, illustrated is a side view of main cup housing portion 5. The main cup housing portion 5 comprises the first cup threading 20 and the second cup threading 21 that circumscribe the upper portion of the main cup thus facilitating a screwing of the housing lid portion 6 to the main cup housing portion 5. Furthermore, in an aspect, also illustrated is main cup lip portion 22 and the left receiving notch 18.

Figure 6:
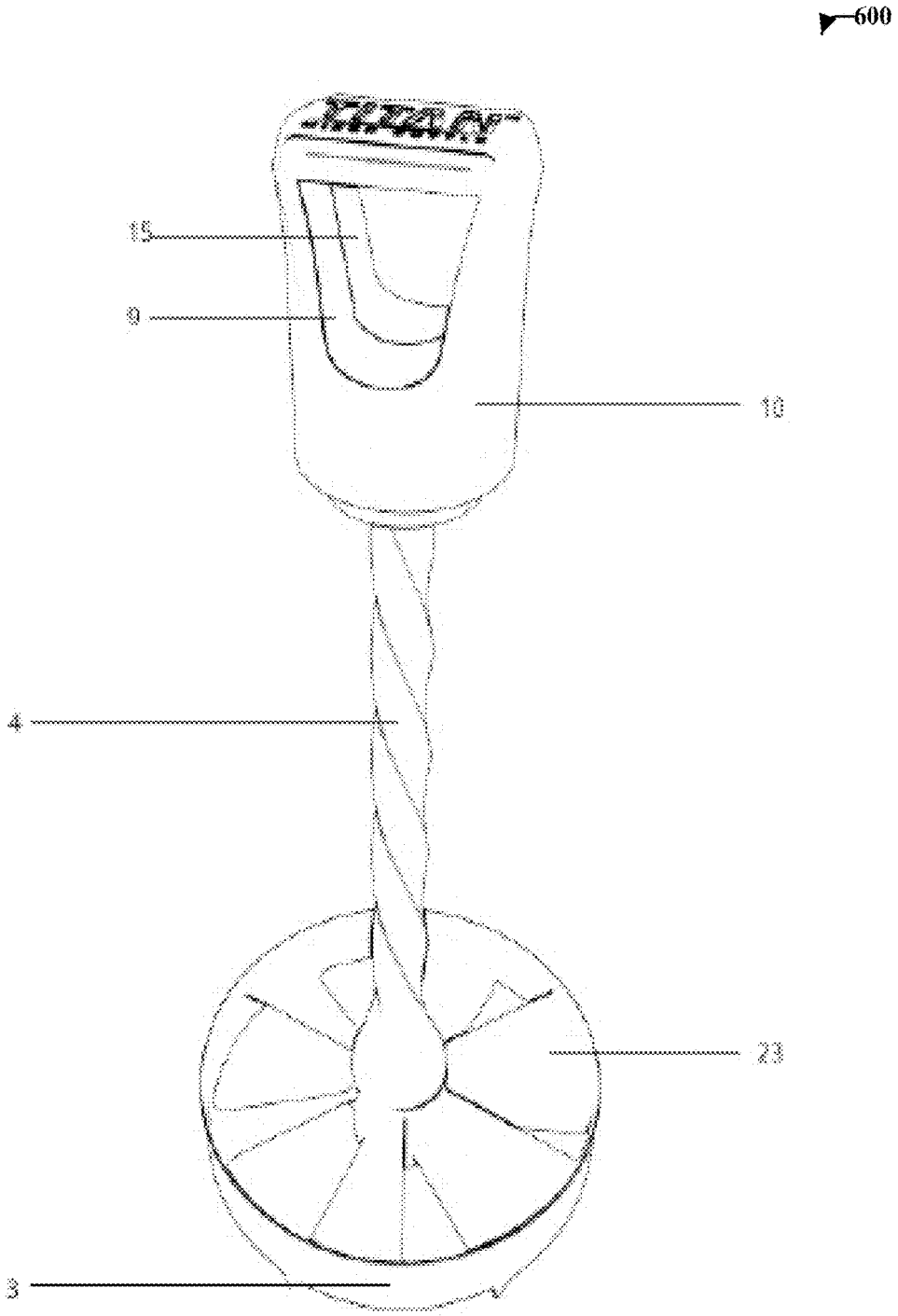
FIG. 6 illustrates a non-limiting high-level diagram of a top view of an angled top view of helical shaft portion and impeller portion of an example apparatus in accordance with the subject application.

Turning now to FIG. 6, illustrated is a non-limiting aspect of apparatus 600 in accordance with various aspects and implementations of this disclosure. In an aspect, illustrated is an impeller portion 3, a helical shaft portion 4, a first handle half 9, and a second handle half 10. In an aspect, the impeller portion 3 is configured to rotate downward or upward within the main cup housing portion 5, wherein a movement of the impeller portion 3 downward or upward is capable of mixing the contained set of substances, wherein the impeller portion 3 comprises a set of propeller blades, and wherein the impeller portion 3 is connected to a helical shaft portion 4 comprising a first helical strand and a second helical strand wound uniformly in in a parallel spiral configuration.

In an aspect, the helical shaft portion 4 comprises a first helical strand wound around a second helical strand. The helix design and shape allows for the spinning of the helical shaft portion 4 as its guided through a grooved opening in the housing lid portion 6. The grooved opening causes the helical shaft portion 4 to rotate as it is drawn upward and pushed downward out of and into the grooved opening respectively. Furthermore, the helical shaft portion 4 is connected to the impeller portion 3 thereby causing the impeller to rotate as well. The first handle half 9, and a second handle half 10 snap together around a top round peg portion 27 of the helical shaft portion 4 to allow for the rotating of the helical shaft and the spherical ball within the pump handle. In another aspect, a rubber shell can be included to cover the pump handle. Furthermore, the rubber shell can seal a set of pressurized release holes located in the housing lid portion 6. Thus when the pump handle is fully pushed down in the main cup housing portion 5 can seal the pressurized release holes.

Turning now to FIG. 6, illustrated is a non-limiting aspect of apparatus 600 in accordance with various aspects and implementations of this disclosure. In an aspect, disclosed are a first handle half 9, a second handle half 10, a helical shaft portion 4, a set of propeller blades 23, and an impeller portion 3. In an aspect, the impeller portion 3 comprises the set of propeller blades 23 radiating outward from a central impeller opening configured to receive a bottom shaft end of the helical shaft portion 4, wherein the bottom shaft end comprises a first snapping prong and a second snapping prong configured to connect to the central impeller opening using a snapping (e.g., using prong portion 26) mechanism, and wherein the set of propeller blades 23 are sloping at an angle between a lower impeller rim and an upper impeller rim, and wherein the set of propeller blades 23 overhang from the lower impeller rim 64.

In an aspect, the propeller blades 23 are angled fan-like propellers that are connected to the lower impeller rim and the upper impeller rim. The propeller blade of the set of propeller blades 23 start at a connection point on the upper rim of the impeller rim and connect at a connector point at a different location on the lower impeller rim (e.g., the point on the upper impeller rim 64 and the lower impeller rim 66 where the blades connect to the respective impeller rims are not along the same longitudinal axis). The connection at different locations on each respective rim allows for each propeller blade to be tilted at an angle. Consequently, when the propeller blades contact the substances (e.g., liquid and powder substances) within the main cup housing portion 5, an increased surface area of the blades are able to contact such substances and cause the substances to pass over such blades.

Furthermore, in an aspect, the set of propeller blades 23 rotate as a result of the helical shaft portion 4 and impeller portion 3 rotating (e.g., during an upward and downward pumping of the pump handle). The rotational action of the impeller portion 3 cause the set of propeller blades 23 to create a vortex or pushing and pulling forces that facilitate the churning of the substances (e.g., liquid and powder mixtures) within the main cup housing portion 5 thus resulting in a mixing of the substances. The set of propeller blades 23 efficaciously mix the substances within the main cup housing portion 5 in that the rotation of the blades create a torque throughout the substances in the main cup housing portion 5 that constantly mixes the substances such as liquids and powders together.

Also, in an aspect, the impeller portion 3 moves up and down throughout the main cup housing portion 5 and therefore interfaces with the substances all throughout the main cup housing portion 5 (e.g., at the top of the cup cavity, at the middle of the cup cavity, at the base of the cup cavity, etc.). Furthermore, in an aspect, each blade and the impeller portion 3 interface with the entire substance throughout the main cup housing portion 5, where the up and down motion throughout the cup cavity causes the mixing unit (e.g., impeller portion 4 and set of propeller blades 23) to move through the substances layer by layer allowing for a higher level of mixing performance. Thus a powdered substance can evenly disburse throughout a liquid substance without giving rise to clumps.

Figure 7:
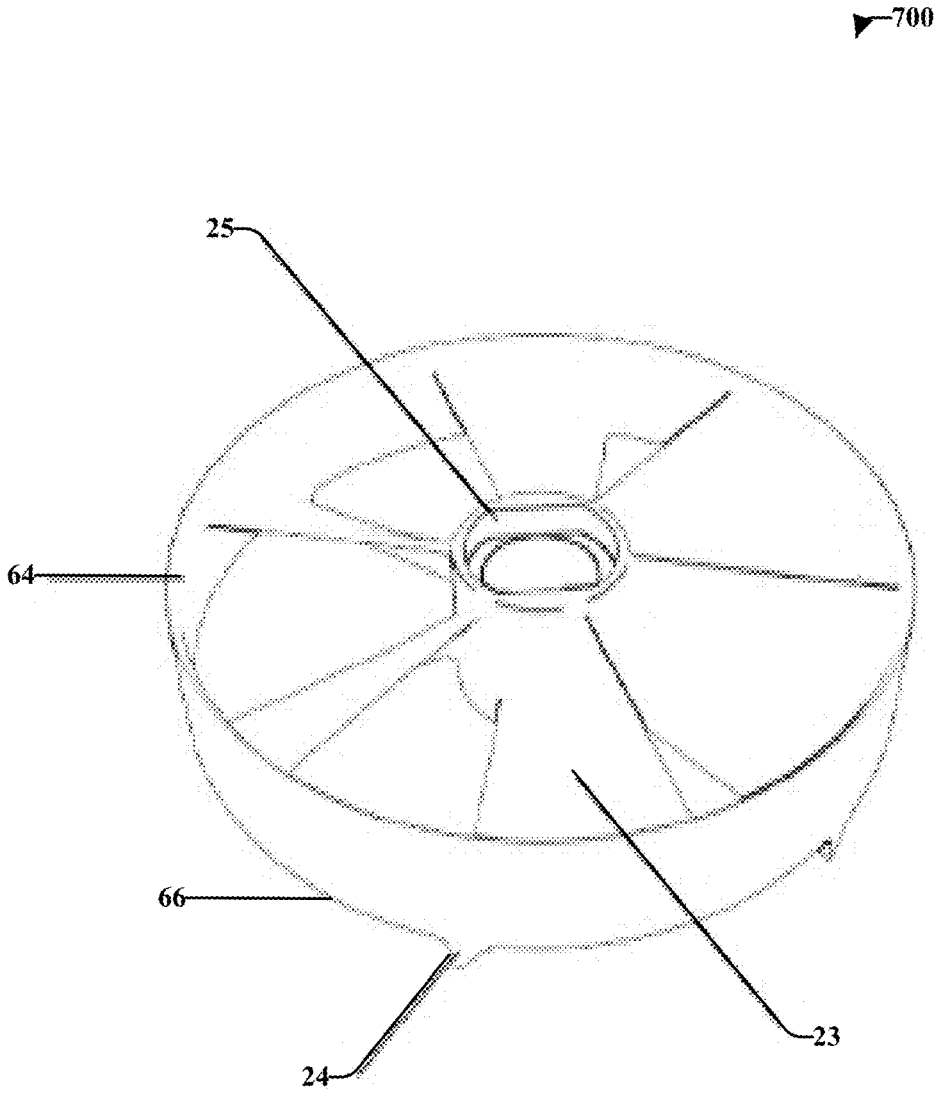
FIG. 7 illustrates a non-limiting high-level diagram of an angled top view of an impeller portion of an example apparatus in accordance with the subject application.

Turning now to FIG. 7, illustrated is a non-limiting aspect of apparatus 700 in accordance with various aspects and implementations of this disclosure. In an aspect, impeller portion 3 is illustrated. Furthermore, also illustrated is the overhang region 24 of the propeller blades. In an aspect, the propeller blades each extend beyond the lower rim of the impeller portion 3 such that the lower region of the propeller blade is protruding. As such, when the impeller portion 3 is pushed downward (e.g., to the bottom of the main cup housing portion 5) to the base of the main cup housing portion 5, the overhang region 24 can touch the base of the main cup portion 5. The overhang regions 24 of the propeller blades touch the base of the main cup housing portion 5 and accordingly dislodge any clumps and built up substance or matter on the base. This aspect of apparatus 700A further allows for all the substance to mix properly and facilitates easier cleaning of the apparatus due to less substance sticking to the interior of the main cup housing portion 5.

In an aspect, impeller portion 3 comprises a set of propeller blades 23 and an impeller opening 25 designed to receive the lower end of the helical shaft portion 4. In an aspect, the helical shaft portion 4 terminates into two prongs that snap into the impeller opening 25. As such, the two prongs (e.g., prong portion 26) push closer together in order to fit into the impeller opening 25 and also the two prongs can expand after passing through impeller opening 25 to fasten to the impeller portion 3 to the helical shaft portion 4.

Figure 8:
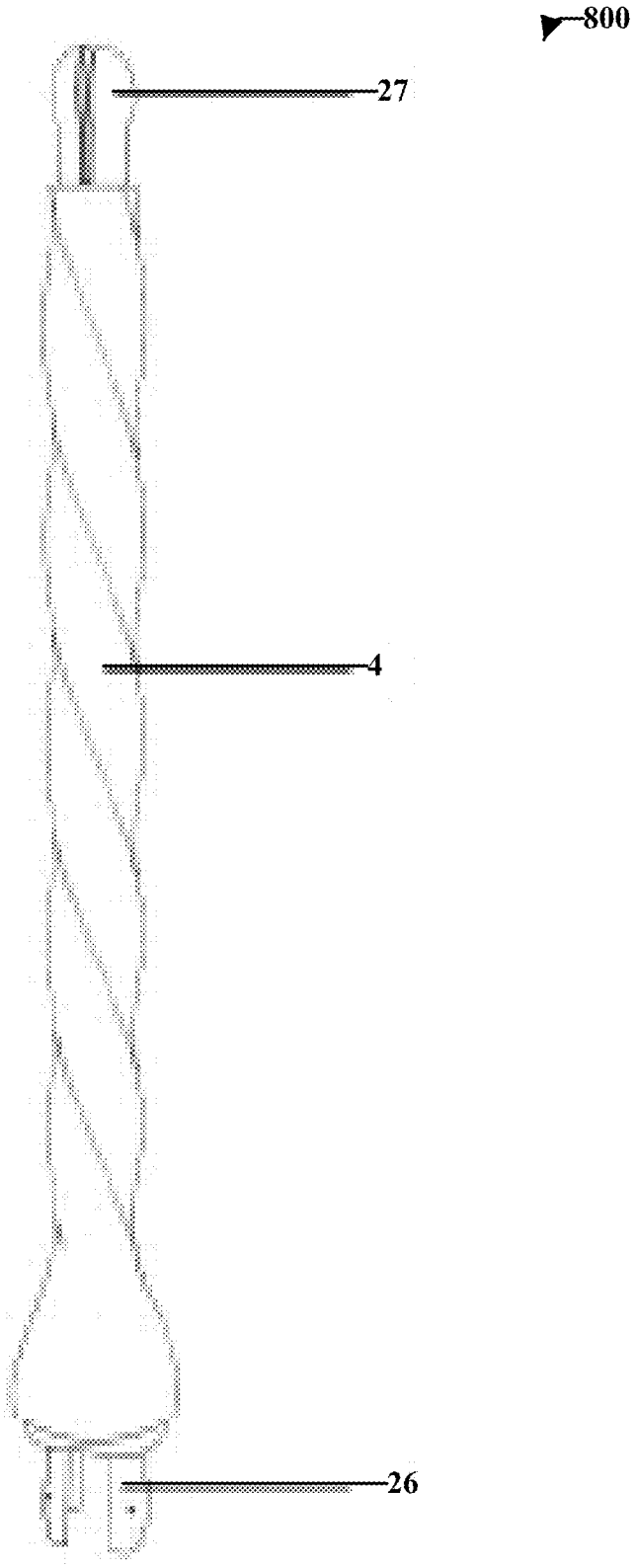
FIG. 8 illustrates a non-limiting high-level diagram of a side view of helical shaft portion of an example apparatus in accordance with the subject application.

Referring now to FIG. 8, illustrated is a non-limiting aspect of apparatus 800 in accordance with various aspects and implementations of this disclosure. In an aspect, illustrated is a non-limiting example embodiment of a helical shaft portion 4 comprising a top round peg portion 27 and prong portion 26. In an aspect, top round peg portion 27 is capable of sitting within a cavity formed by the first handle half 9 and the second handle half 10. The top peg portion 27 can freely rotate within the pump handle cavity thus allowing the helical shaft portion 4 to rotate freely as well as the impeller portion 3 connected by the prong portion 26 which clips into the impeller opening 25.

Figure 9:
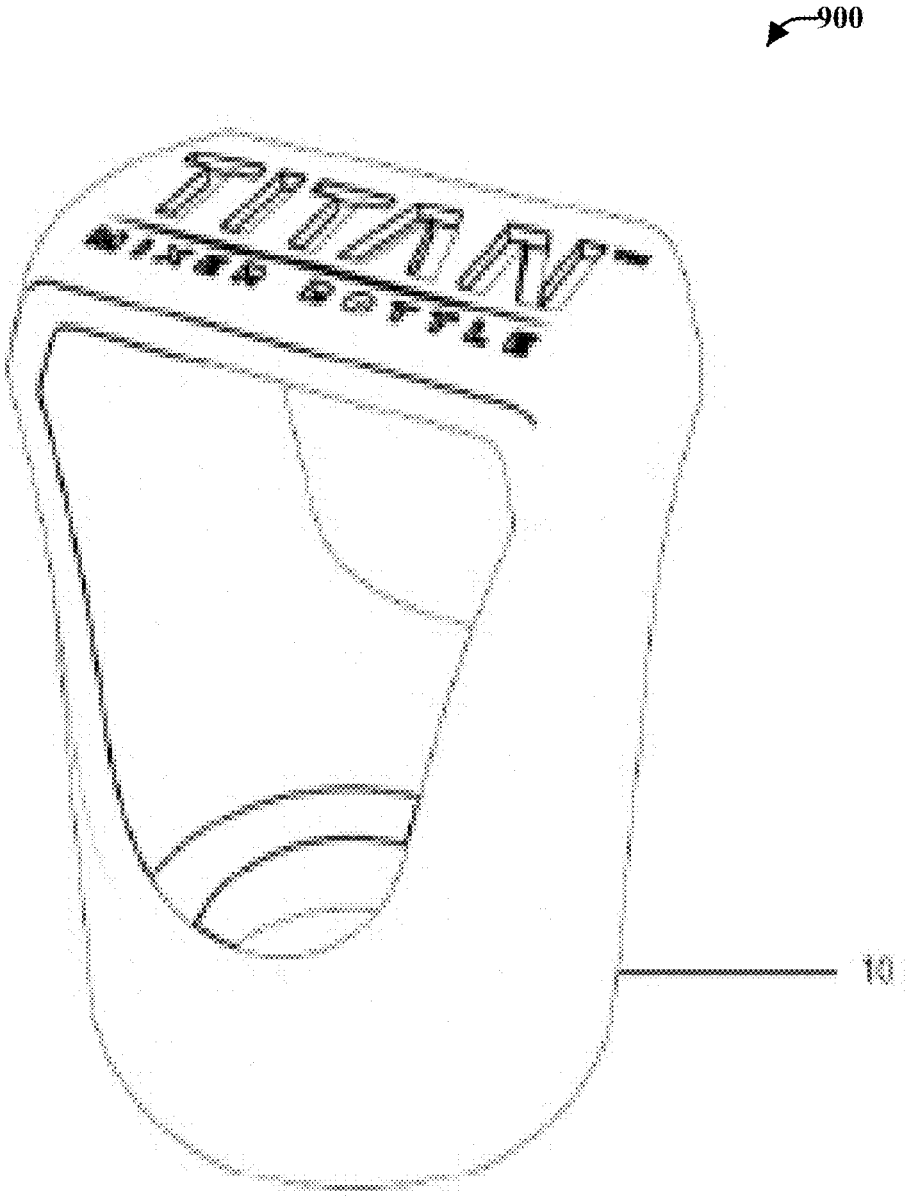
FIG. 9 illustrates a non-limiting high-level diagram of an angled top view of pump handle portion of an example apparatus configured to store and mix substances in accordance with the subject application.

Referring now to FIG. 9, illustrated is a non-limiting aspect of apparatus 900 in accordance with various aspects and implementations of this disclosure. In an aspect, illustrated is a top view of the pump handle 10 comprising a first handle half 9 and a second handle half 10. In an aspect, the pump handle 10 can comprise a design such as the "T" symbol illustrated in FIG. 9.

Figure 10:
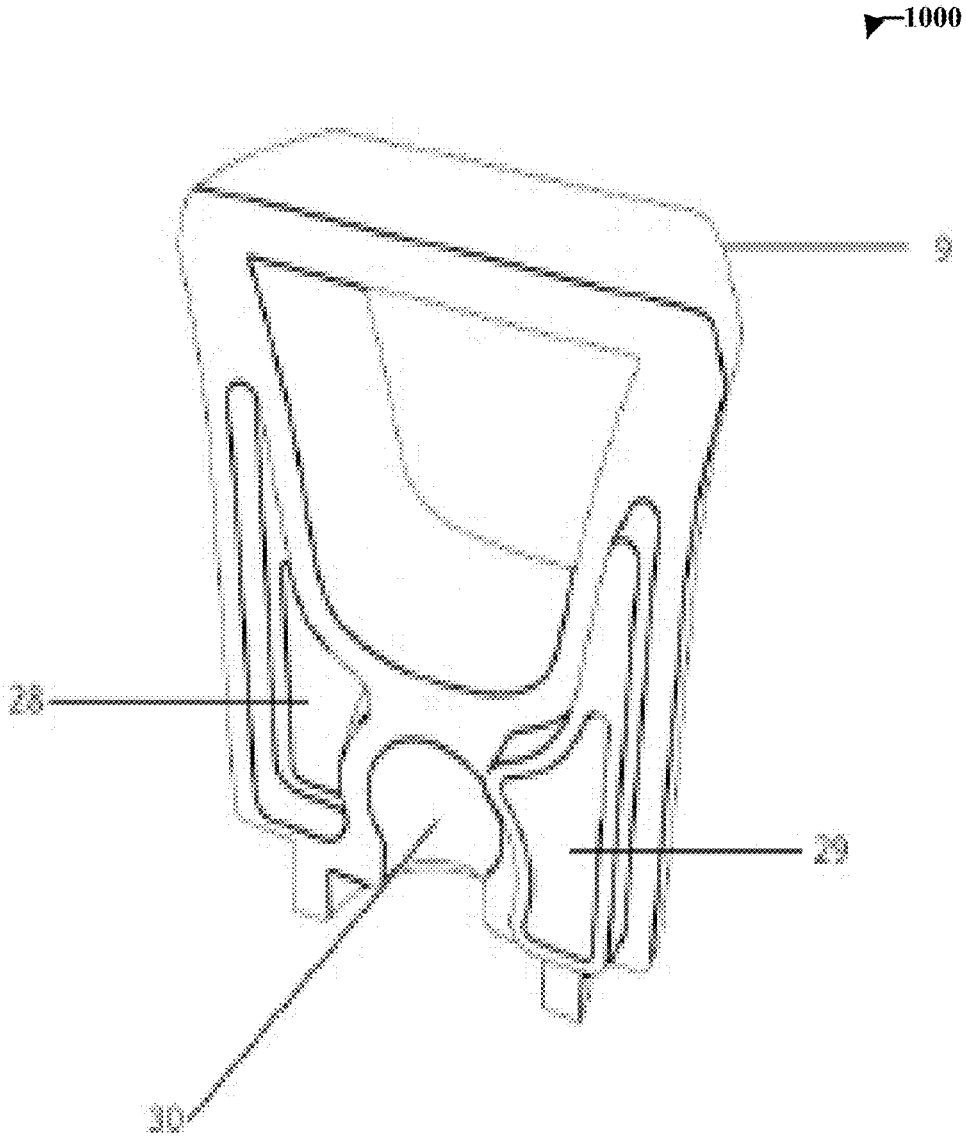
FIG. 10 illustrates a non-limiting high-level diagram of a side view of first pump handle half portion of an example apparatus in accordance with the subject application.

Referring now to FIG. 10, illustrated is a non-limiting aspect of apparatus 1000 in accordance with various aspects and implementations of this disclosure. Illustrated is a first handle half 9. In an aspect, the first handle half 9 comprises a first receiving cavity 28 and a first clasping protrusion 29 and the second handle half 15 comprises a second clasping protrusion 32 and a second receiving cavity 33, wherein the first clasping protrusion is configured to snap into the second receiving cavity 33 and the second clasping protrusion 32 is configured to snap into the first receiving cavity 28. Thus the first handle half 9 and the second handle half 15 snap together to form pump handle 10. In an aspect, the first handle half 9 further comprises a first peg cast 30 and the second handle half 10 comprises a second peg cast 31, and wherein the first peg cast 30 and the second peg cast 31 are configured to encapsulate the top round peg portion 27 of the helical shaft portion 4. In an aspect, the first peg cast 30 and the second peg cast 31 are snapped together around the top round peg portion 27 and allow for the full three hundred sixty-degree rotation of the top round peg portion 27 within the cavity formed by the snapped together first peg cast 30 and second peg cast 31.

Also, the clasping protrusions and receiving cavities fasten together the first handle half 9 and the second handle half 15 together. Thus, each clasping protrusion or a respective handle half is aligned with a complimentary receiving cavity on the opposite handle half and allows for a snapping fastening mechanism to hold them together. This fastens the two sides together such that the first peg cast 30 and the second peg cast 31 securely cradle the top round peg portion 27.

Figure 11:
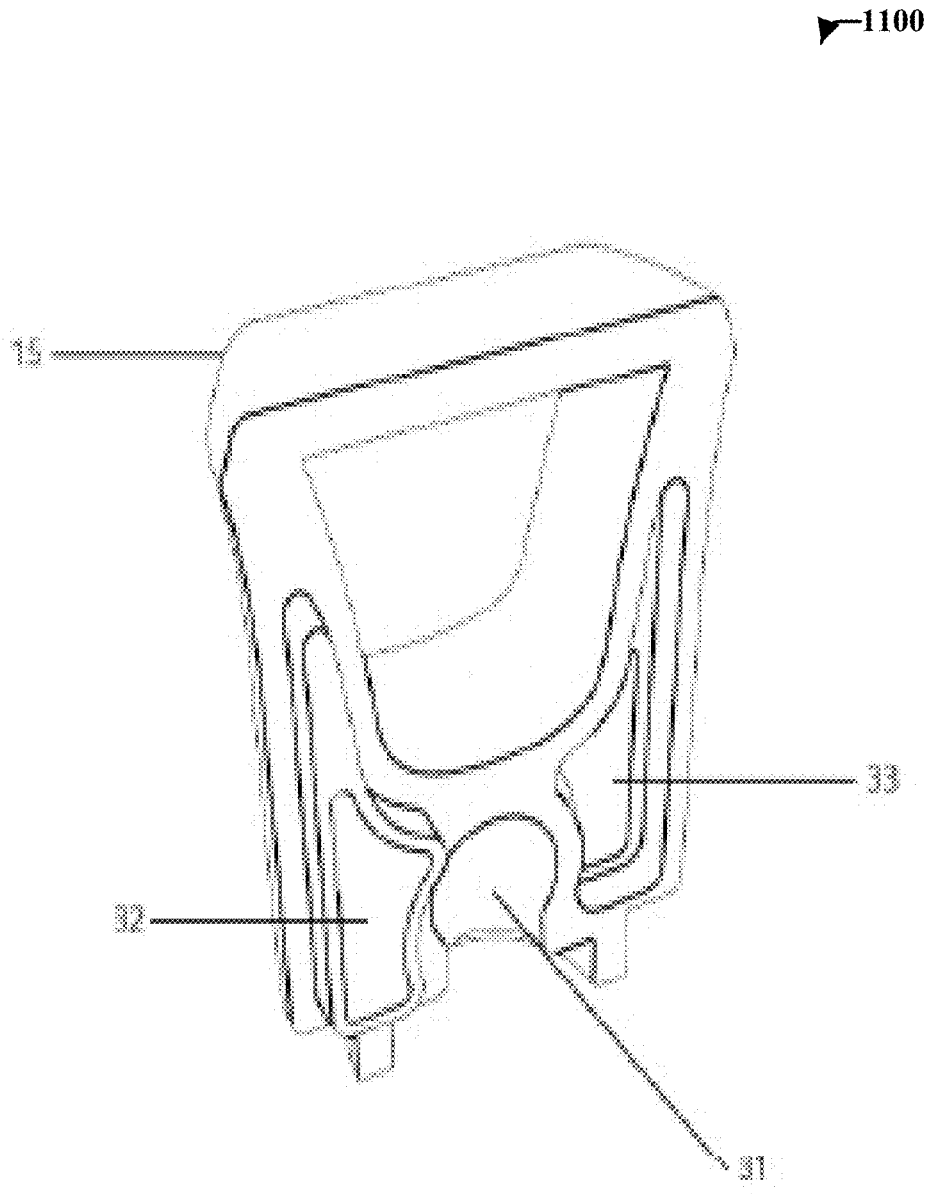
FIG. 11 illustrates a non-limiting high-level diagram of a side view of second pump handle half portion of an example apparatus in accordance with the subject application.

Referring now to FIG. 11, illustrated is a non-limiting aspect of apparatus 1100 in accordance with various aspects and implementations of this disclosure. Illustrated is an angled side view of second handle half 10 comprising second clasping protrusion 32 and second receiving cavity 33. In an aspect, the second handle half 15 is capable of snapping into the first handle half 9 by snapping second clasping protrusion 32 into first receiving hole 28 and snapping first clasping protrusion 29 into second receiving cavity 33. Such snapping of each respective clasp into each respective cavity fastens the first handle half 9 and the second handle half 15 together as well as the first peg cast 30 and the second peg cast 31 around the top round peg portion 27.

Figure 12A:
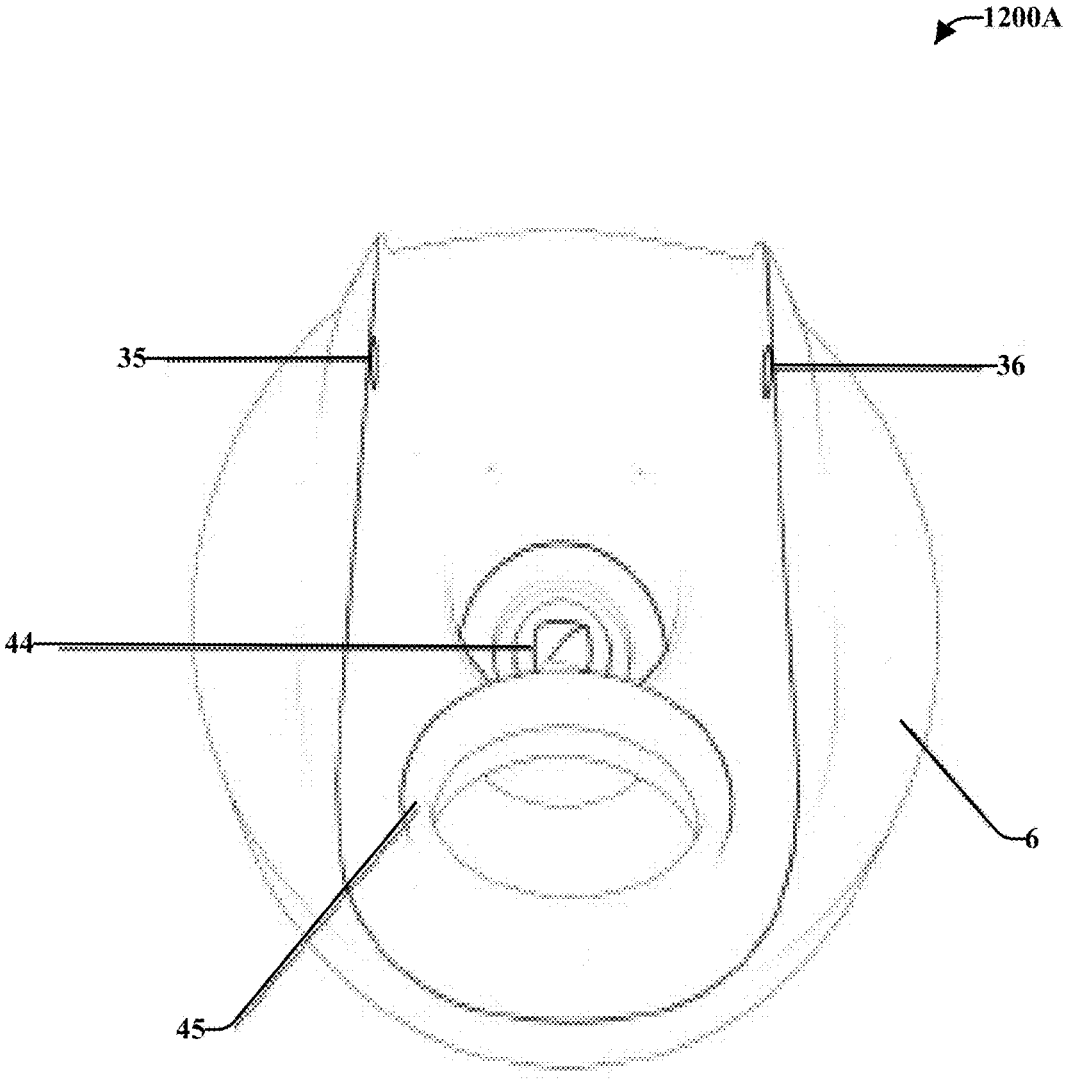
FIG. 12A illustrates a non-limiting high-level diagram of an angled top view of a housing lid portion of an example apparatus in accordance with the subject application.

Referring now to FIG. 12A, illustrated is a non-limiting aspect of apparatus 1200A in accordance with various aspects and implementations of this disclosure. In an aspect, illustrated is a housing lid portion 6. The housing lid portion 6 comprises a left housing lid hinge hole 35, a right housing lid hinge hole 36, a helically grooved cavity 44, a drinking lip 62, a housing lid opening 45, and a set of housing lid threading 38, wherein the left housing lid hinge hole 35 and the right housing lid hinge hole 36 are configured to receive a right latch peg 47 and a left latch peg 56 associated with a carrying clip handle 8, wherein the helically grooved cavity 40 is configured to circumscribe the helical stem portion 4 and facilitate the helical stem portion 4 to move up and down within the helically grooved cavity 44, wherein the housing lid opening 45 is capable of facilitating access to the set of substances within the main cup housing portion 5, and wherein the housing lid threading 38 is located at a housing lid underside and facilitates the housing lid portion 6 to interlock to the main cup top end 52 via a screwing mechanism.

In an aspect, the housing lid portion 6 is capable of screwing on and off of the main cup housing portion 5. Furthermore, in an aspect, the drinking lip 62 allows for a user to easily drink the contents of the main cup housing portion 5 by passing the contents such as mixed substances through the drinking lip 39. Also, the helical grooved cavity 44 is an opening that allows for the receipt of the helical shaft portion 4. The helical grooved cavity 44 is molded to fit the twisting design of the helical shaft portion 4, such that as the helical shaft portion 4 is moved into and out of the (e.g., up and down through the helical grooved cavity 44) helical grooved cavity 44 it twists and rotates according to its curvature. Thus, the helical grooved cavity 44 induces the helical shaft portion 4 to rotate as it moves through the helical grooved cavity 44.

Additionally, the rotation of the helical shaft portion 4 also causes the top round peg portion 27 to rotate within the first peg cast 30 and the second peg cast 31 as well as the impeller portion 3 connected to the helical shaft portion 4. Also, in an aspect, the left housing lid hinge hole 35 and the right housing lid hinge hole 36 are cavities configured to receive the housing lid plug latch which is configured to plug closed (and is capable of exposing the opening) the drinking lip 39. Furthermore, in an aspect, the housing lid plug latch can swing open and shut on via the left housing hinge hole 41 and the right housing hinge hole 36.

Figure 12B:
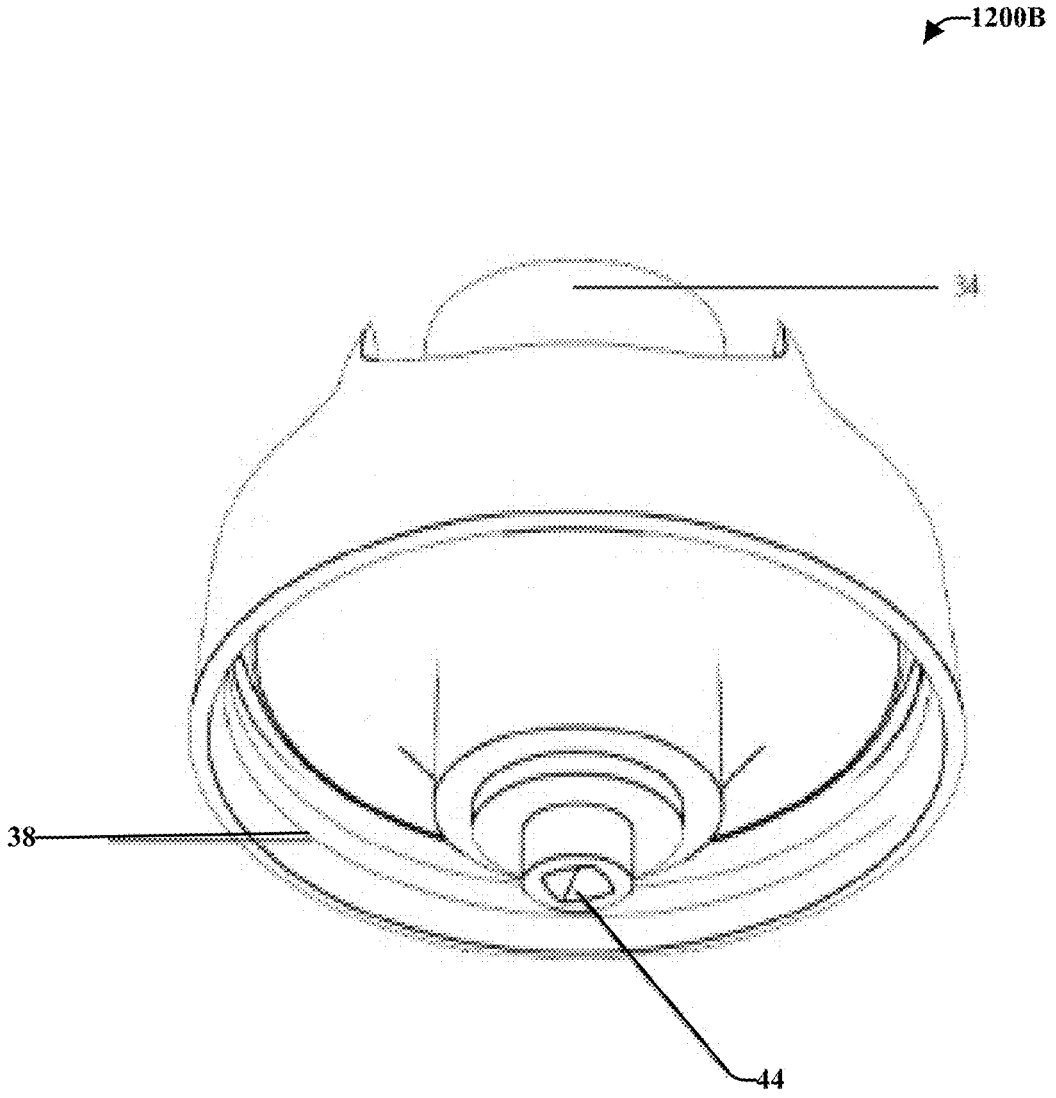
FIG. 12B illustrates a non-limiting high-level diagram of an angled bottom view of a housing lid portion of an example apparatus in accordance with the subject application.

Turning now to FIG. 12B, illustrated is a non-limiting embodiment of apparatus 1200B in accordance with various aspects and implementations of this disclosure. In an aspect, disclosed is a bottom view of the underside of housing lid portion 6 comprising a housing lid opening 45, a helical grooved cavity 44, and a set of housing lid threading 38. In an aspect, the housing lid threading can comprise grooves that circumscribe the inner rim of the underside of housing lid portion 6. The threading facilitates the screwing and unscrewing of the housing lid portion 6 onto the main cup housing portion 5 top end. In another aspect, the housing lid opening 45 allows contents of main cup housing portion 5 to pass through to a user. However, if the drinking lip 62 is plugged closed then the contents of main cup housing portion 5 will be prevented from flowing past the plug 58.

Figure 13A:
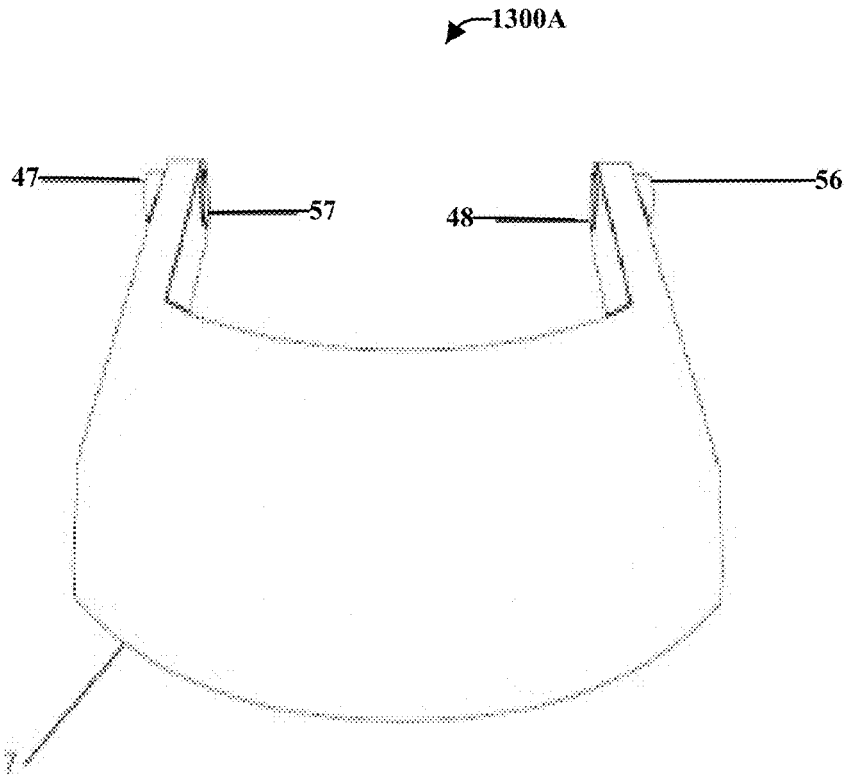
FIG. 13A illustrates a non-limiting high-level diagram of an angled top view of a latch portion of an example apparatus in accordance with the subject application.

Turning now to FIG. 13A, illustrated is a non-limiting embodiment of apparatus 1300A in accordance with various aspects and implementations of this disclosure. In an aspect, disclosed is a housing lid plug latch 1300A comprises a plug 58, the left latch peg 56, the right latch peg 47, a left latch groove 48, and a right latch groove 57, wherein the plug 58 is capable of sealing the housing lid opening 45 or exposing the housing lid opening 45 to facilitate access to the set of substances within the main cup housing portion 5, wherein the left latch peg 56 and the right latch peg 47 are configured to snap into the left housing lid hinge hole 41 and the right housing lid hinge hole 61, and wherein the left latch groove 48 and the right latch groove 57 are configured to receive a right clip peg 49 and a left clip peg 60 of the carrying clip portion 8.

In an aspect, the carrying clip portion 8 can swing freely within the left latch groove 48 and right latch groove 57. The right clip peg 49 clips into the right latch groove 57 and the left clip peg 60 clips into the left latch groove 48 to allow for the carrying clip portion 8 to swing within the hinges and for a user to carry the apparatus by the clip handle (e.g., using a finger or a few fingers). In another aspect, the housing lid plug latch itself can swing on its hinges (e.g., right latch peg 47 and left latch peg 56) clipped into latch grooves (e.g., left latch groove 48 and right latch groove 57). Thus the housing lid plug latch can be swung closed such that the plug 58 can act as a stopper to the housing lid opening 45 thus preventing any contents of main cup housing portion 5 from exiting beyond the housing lid plug latch. Also, the housing lid plug latch can be swing open to facilitate a user access to the contents within the main cup housing portion 5. For instance, a user can unplug the housing lid plug latch and drink the contents within main cup housing portion 5 using the drinking lip 39.

In yet another instance, the housing lid plug latch can be closed while a user pumps the pump handle up and down to facilitate mixing of the substances within the main cup housing portion 5. Furthermore, during pumping, air can be released through pressure release holes located in the housing lid plug latch which facilitate pressurization and depressurization of air pressure within the main cup housing portion 5 during the pumping. In another aspect, a rubber stopper can be located at the base of the pump handle to allow for the closing of the pressure release holes when the pump handle 10 is fully pushed downward into the housing lid plug latch.

Figure 13B:
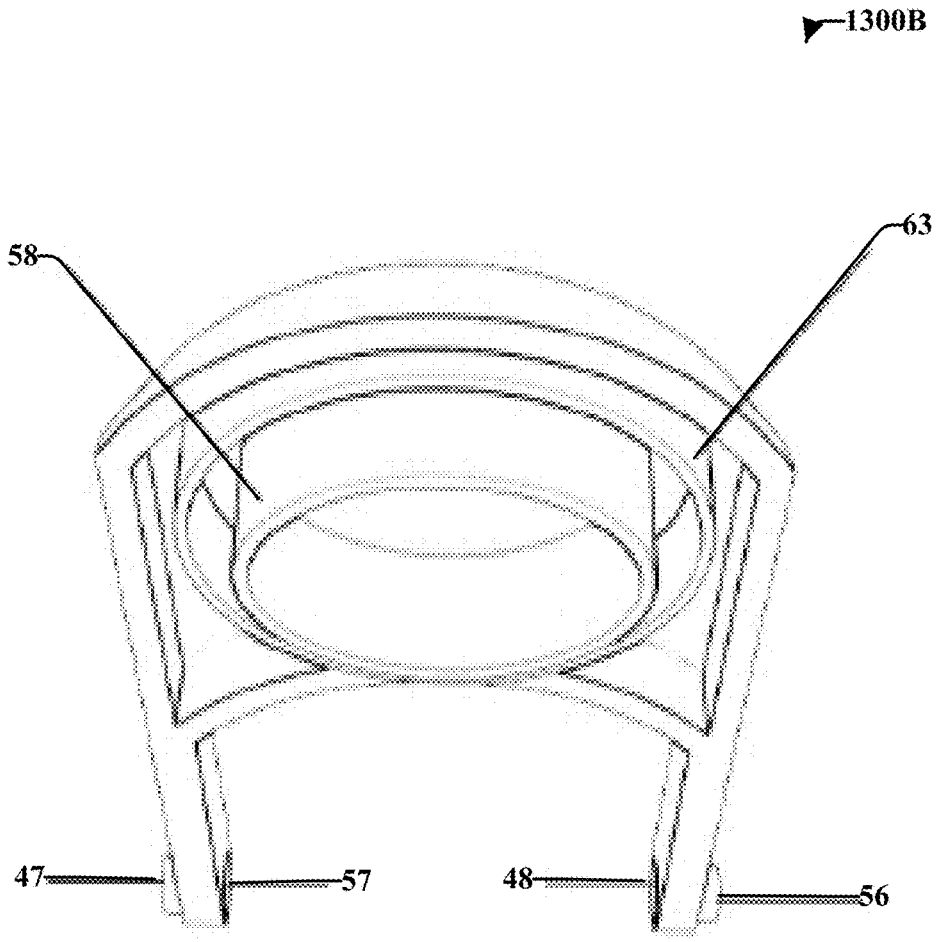
FIG. 13B illustrates a non-limiting high-level diagram of an angled bottom view of a latch portion of an example apparatus in accordance with the subject application.

Turning now to FIG. 13B, illustrated is a non-limiting embodiment of apparatus 1300B in accordance with various aspects and implementations of this disclosure. In an aspect, illustrated is an underside view of housing lid plug latch 1300B comprising a plug 58, the left latch peg 56, the right latch peg 47, a left latch groove 48, and a right latch groove 57. In an aspect, the plug 58 can be clasped into the drinking lip 62 to close off the opening to the main cup housing portion 5 and prevent the contents of the main cup housing portion 5 from spilling. Furthermore, the left latch groove 48 and right latch groove 57 are capable of receiving a left clip peg 60 and a right clip peg 49 respectively. Thus the carrying clip portion 8 can swing freely along the hinge formed by each clip peg within each latch groove.

Figure 14:
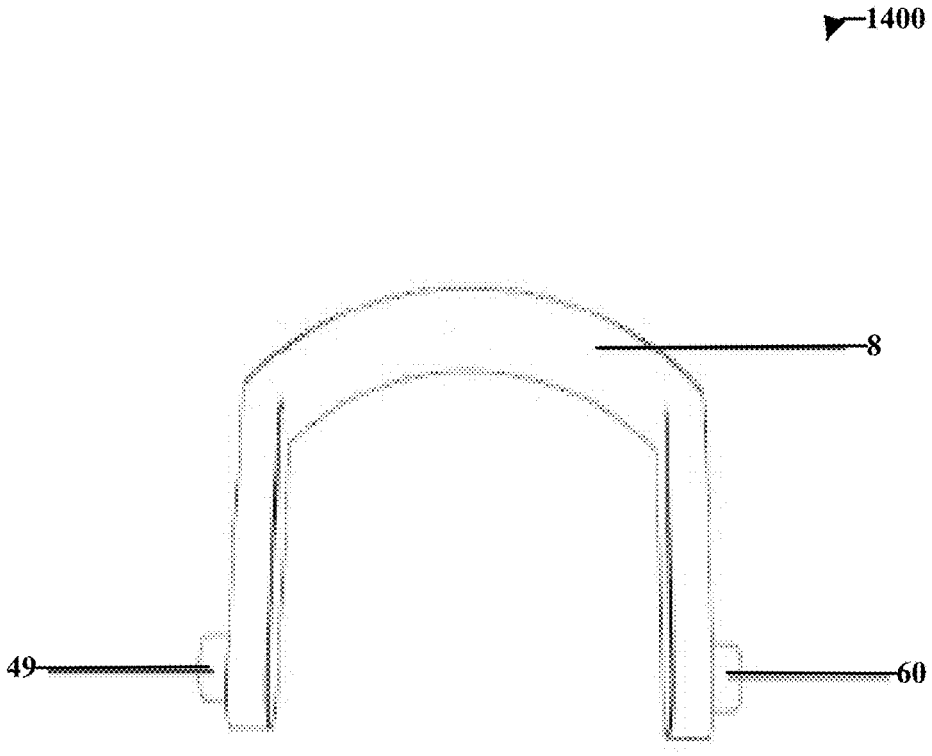
FIG. 14 illustrates a non-limiting high-level diagram of a top view of a clip portion of an example apparatus configured to store and mix substances in accordance with the subject application.

Turning now to FIG. 14, illustrated is a non-limiting embodiment of apparatus 1400 in accordance with various aspects and implementations of this disclosure. In an aspect, illustrated is a clip portion 8 capable of being used to carry the apparatus 1400 using a hand, finger, or set of fingers. The carrying clip handle includes a right clip peg 49 and a left clip peg 60. In an aspect, the left latch groove 48 and the right latch groove 57 are configured to receive a right clip peg 49 and a left clip peg 60 of the carrying clip portion 8.

In a non-limiting embodiment, all of the portions can be combined to form the apparatus. For instance, the apparatus can comprise the main cup housing portion 5 with a screwed on housing lid portion 6 (e.g., attached at the main cup top end 52) and a screwed on receptacle portion 1 (attached at the receptacle portion top end 54 and the main cup base 51). Furthermore, the apparatus can comprise the helical shaft portion 4 attached to the impeller portion 3 via a snapping prong portion 26. The helical shaft portion 4 can also be attached to the pump handle 28 at the top round peg portion 27, where the top round peg portion 27 is encased by a cavity formed within the first peg cast 35 and the second peg cast 55 snapped together. The first handle half 9 and the second handle half 15 can be snapped together using a first clasping protrusion 29 and a second clasping protrusion 32 snapped into a second receiving cavity 28, and a second receiving cavity 33.

Furthermore, in an aspect, the impeller portion 3 can comprise a set of propeller blades 23, an overhang region 24 to facilitate dislodging of debris formed at the main cup base 51 and a helically grooved cavity 40 configured to receive the snapping prong portion 26. In another aspect, the housing lid portion 6 can comprise a pump handle 10 attached to the helical shaft portion 4. The housing lid portion 6 can also include a lid opening 11 that can be plugged by a plug 58. Also the housing lid portion 6 can comprise a drinking lip 62 to drink the contents of the main cup housing portion 5 out of. Furthermore, in an aspect, the housing lid portion 6 can comprise a carrying clip portion 8 to facilitate the carrying of the apparatus.

Also, the receptacle portion 1 can be used for storing substances such as powders within its receptacle compartment. The top of the receptacle portion 1 can be covered by a funnel lid portion 2 that includes a gradient funnel wall 14, a funnel spout 11 and a first funnel tab 17 as well as second funnel tab 16 to connect the receptacle portion 1 and funnel lid portion 2 to the main cup base 51. Furthermore, in an aspect, the funnel lid portion 2 can be detached from the receptacle portion 1 and inserted at the funnel spout 15 into the drinking lip 62 to facilitate the clean and efficient pouring of items (including the contents within the receptacle portion 1) into the main cup housing portion 5.

FIGS. 15-19 illustrate various methodologies in accordance with certain embodiments of this disclosure. While, for purposes of simplicity of explanation, the methodologies are shown media a series of acts within the context of various flowcharts, it is to be understood and appreciated that embodiments of the disclosure are not limited by the order of acts, as some acts may occur in different orders and/or concurrently with other acts from that shown and described herein. For example, those skilled in the art will understand and appreciate that a methodology can alternatively be represented as a series of interrelated states or events, such as in a state diagram. Moreover, not all illustrated acts may be required to implement a methodology in accordance with the disclosed subject matter. Additionally, it is to be further appreciated that the methodologies disclosed hereinafter and throughout this disclosure are capable of being implemented by an apparatus as disclosed herein. It is noted that the methods depicted in FIGS. 15-19 can be performed by various apparatus's disclosed herein, such as apparatus 100A, 100B, 200, 300A, 300B, 300C, 400A, 400B, 500A, 500B, 600A, 600B, 700A, 700B, 700C, 800, 900A, 900B 1000A, 1000B 1100, 1200A, 1200B, 1300A, 1300B and 1400.

Figure 15:
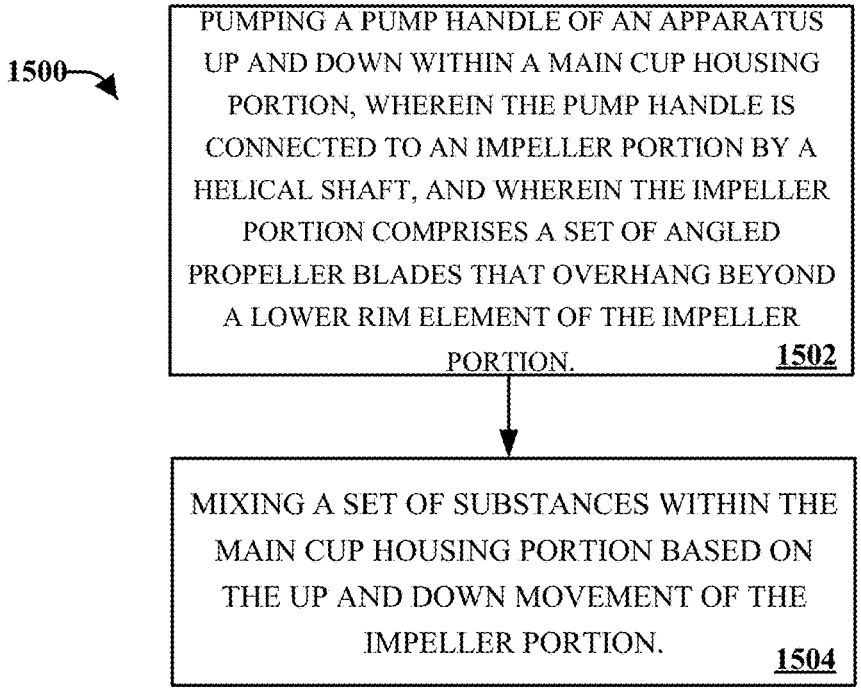
FIG. 15 illustrates a non-limiting high-level block diagram of an example method 1500 configured to store and mix substances in accordance with the subject application.

FIG. 15 provides an example method 1500 for storing and mixing substances in accordance with aspects and embodiments described herein. Repetitive description of like elements employed in system and methods disclosed herein is omitted for sake of brevity.

At 1502, a pump handle (e.g., using pump handle 28) of an apparatus is pumped up and down within a main cup housing portion (e.g., using main cup housing portion 5), wherein the pump handle (e.g., using pump handle 28) is connected to an impeller portion (e.g., using impeller portion 3) by a helical shaft (e.g., using helical shaft portion 4), and wherein the impeller portion comprises a set of angled propeller blades (e.g., using the set of propeller blades 23) that overhang (e.g., using overhang region 24) beyond a lower rim element of the impeller portion. At 1504, a set of substances are mixed (e.g., using impeller portion 3) within the main cup housing portion based on the up and down movement (e.g., using pump handle 28) of the impeller portion.

Figure 16:
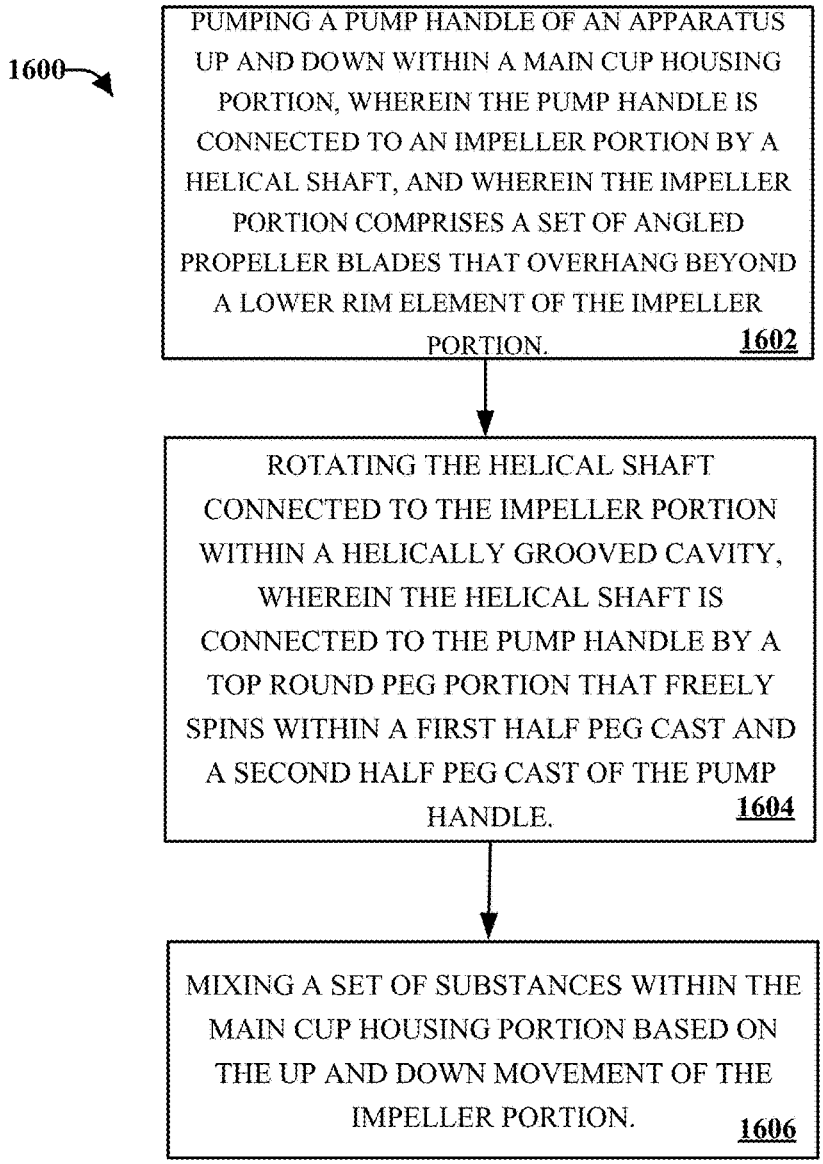
FIG. 16 illustrates a non-limiting high-level block diagram of an example method 1600 configured to store and mix substances in accordance with the subject application.

FIG. 16 provides an example method 1600 for storing and mixing substances in accordance with aspects and embodiments described herein. Repetitive description of like elements employed in system and methods disclosed herein is omitted for sake of brevity.

At 1602, a pump handle (e.g., using pump handle 28) of an apparatus is pumped up and down within a main cup housing portion (e.g., using main cup housing portion 5), wherein the pump handle (e.g., using pump handle 28) is connected to an impeller portion (e.g., using impeller portion 3) by a helical shaft (e.g., using helical shaft portion 4), and wherein the impeller portion comprises a set of angled propeller blades (e.g., using the set of propeller blades 23) that overhang (e.g., using overhang region 24) beyond a lower rim element of the impeller portion.

At 1604, the helical shaft connected to the impeller portion within a helically grooved cavity is rotated (e.g., using pump handle 28 to push and pull the helical shaft portion 4 up and down), wherein the helical shaft is connected to the pump handle by a top round peg portion that freely spins within a first half peg cast and a second half peg cast of the pump handle. At 1606, a set of substances are mixed (e.g., using impeller portion 3) within the main cup housing portion based on the up and down movement (e.g., using pump handle 28) of the impeller portion.

Figure 17:
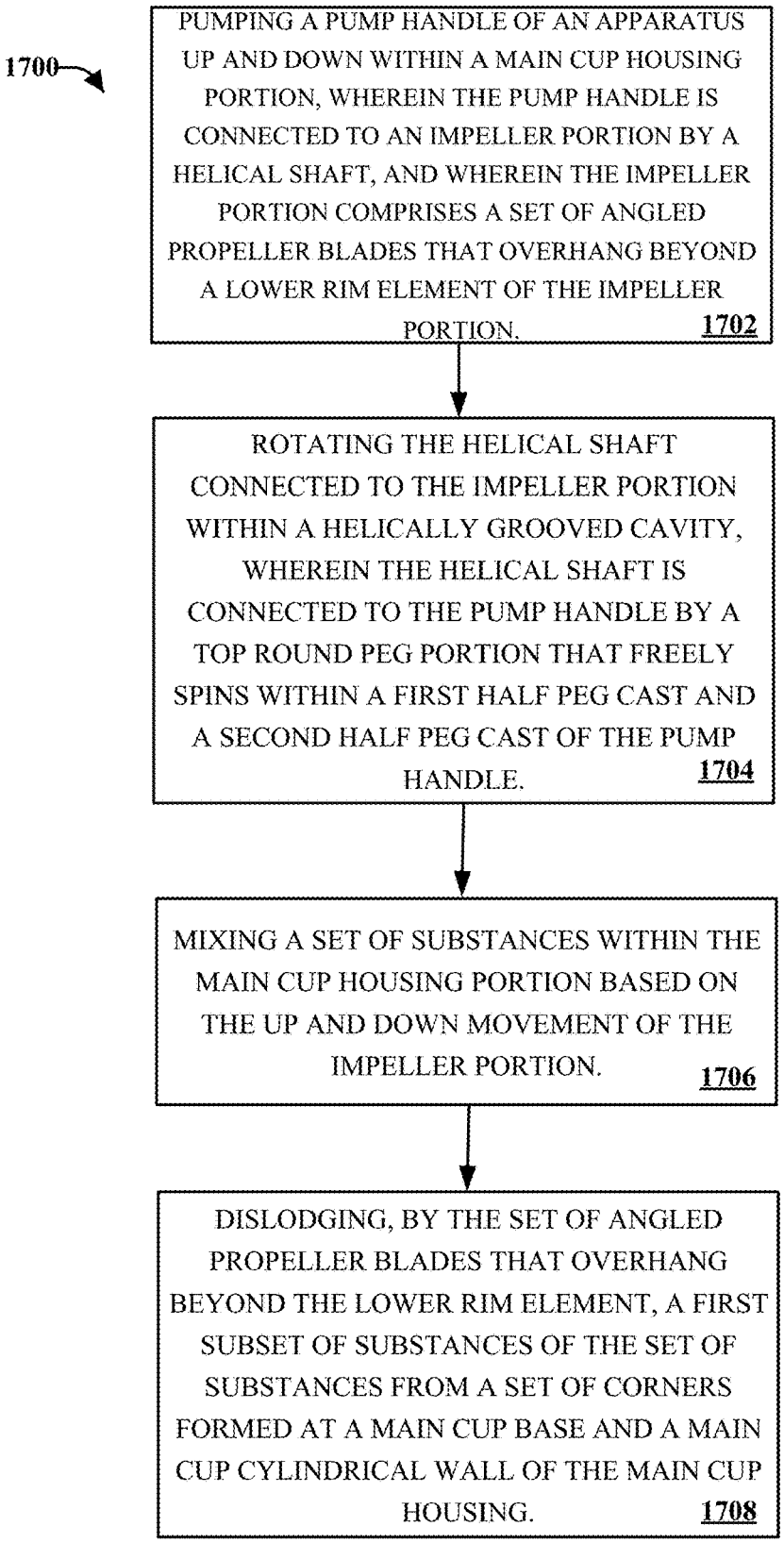
FIG. 17 illustrates a non-limiting high-level block diagram of an example method 1700 configured to store and mix substances in accordance with the subject application.

FIG. 17 provides an example method 1700 for storing and mixing substances in accordance with aspects and embodiments described herein. Repetitive description of like elements employed in system and methods disclosed herein is omitted for sake of brevity.

At 1702, a pump handle (e.g., using pump handle 28) of an apparatus is pumped up and down within a main cup housing portion (e.g., using main cup housing portion 5), wherein the pump handle (e.g., using pump handle 28) is connected to an impeller portion (e.g., using impeller portion 3) by a helical shaft (e.g., using helical shaft portion 4), and wherein the impeller portion comprises a set of angled propeller blades (e.g., using the set of propeller blades 23) that overhang (e.g., using overhang region 24) beyond a lower rim element of the impeller portion.

At 1704, the helical shaft connected to the impeller portion within a helically grooved cavity is rotated (e.g., using pump handle 28 to push and pull the helical shaft portion 4 up and down), wherein the helical shaft is connected to the pump handle by a top round peg portion that freely spins within a first half peg cast and a second half peg cast of the pump handle. At 1706, a set of substances are mixed (e.g., using impeller portion 3) within the main cup housing portion based on the up and down movement (e.g., using pump handle 28) of the impeller portion. At 1708, the set of angled propeller blades that overhang beyond the lower rim element dislodge (e.g., using the set of propeller blades 23 at the overhang region 24) a first subset of substances of the set of substances from a set of corners formed at a main cup base and a main cup cylindrical wall of the main cup housing.

Figure 18:
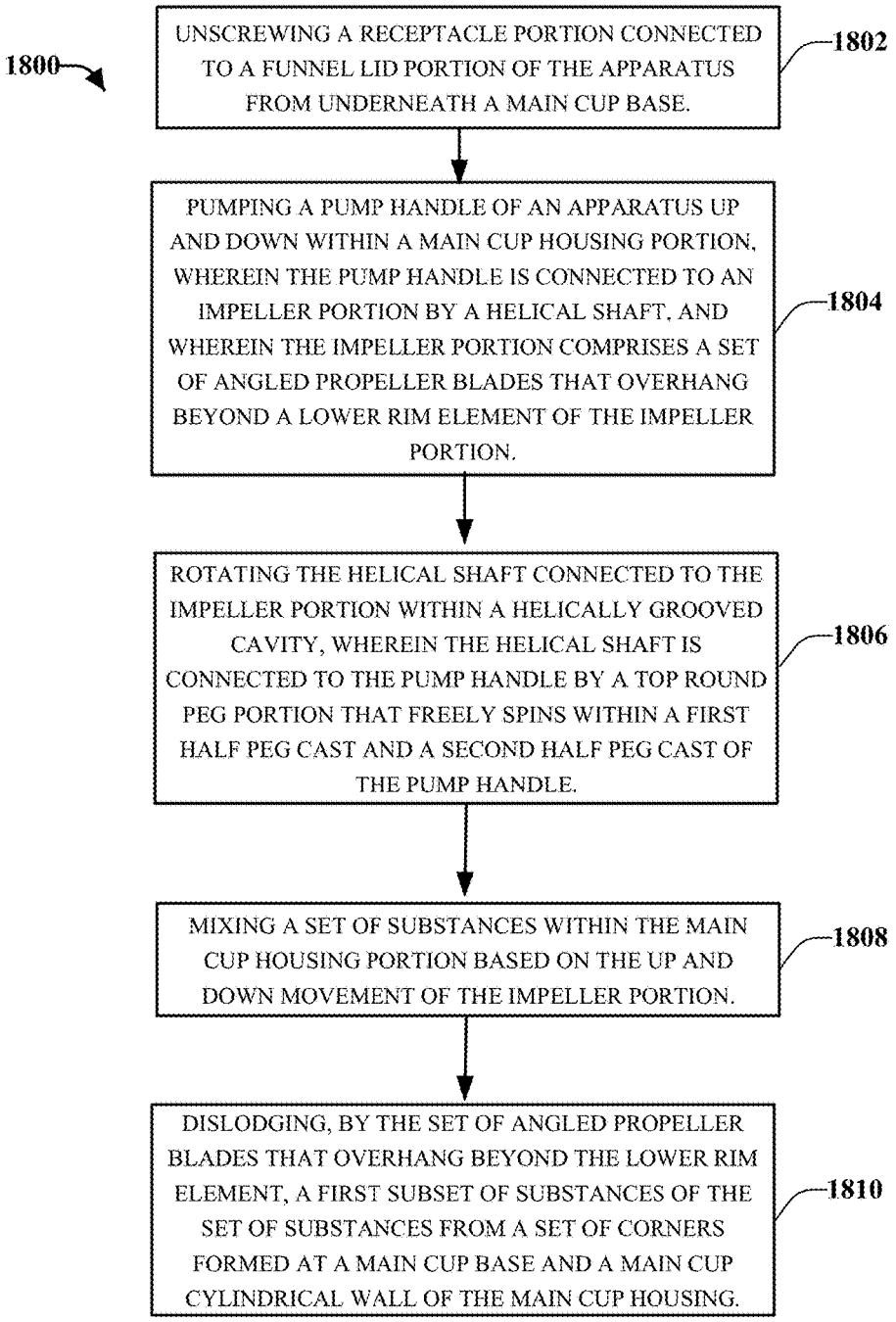
FIG. 18 illustrates a non-limiting high-level block diagram of an example method 1800 configured to store and mix substances in accordance with the subject application.

FIG. 18 provides an example method 1800 for storing and mixing substances in accordance with aspects and embodiments described herein. Repetitive description of like elements employed in system and methods disclosed herein is omitted for sake of brevity.

At 1802, a receptacle portion connected to a funnel lid portion of the apparatus is unscrewed from underneath a main cup base. At 1804, a pump handle (e.g., using pump handle 28) of an apparatus is pumped up and down within a main cup housing portion (e.g., using main cup housing portion 5), wherein the pump handle (e.g., using pump handle 28) is connected to an impeller portion (e.g., using impeller portion 3) by a helical shaft (e.g., using helical shaft portion 4), and wherein the impeller portion comprises a set of angled propeller blades (e.g., using the set of propeller blades 23) that overhang (e.g., using overhang region 24) beyond a lower rim element of the impeller portion.

At 1806, the helical shaft connected to the impeller portion within a helically grooved cavity is rotated (e.g., using pump handle 28 to push and pull the helical shaft portion 4 up and down), wherein the helical shaft is connected to the pump handle by a top round peg portion that freely spins within a first half peg cast and a second half peg cast of the pump handle. At 1808, a set of substances are mixed (e.g., using impeller portion 3) within the main cup housing portion based on the up and down movement (e.g., using pump handle 28) of the impeller portion. At 1810, the set of angled propeller blades that overhang beyond the lower rim element dislodge (e.g., using the set of propeller blades 23 at the overhang region 24) a first subset of substances of the set of substances from a set of corners formed at a main cup base and a main cup cylindrical wall of the main cup housing.

Figure 19:
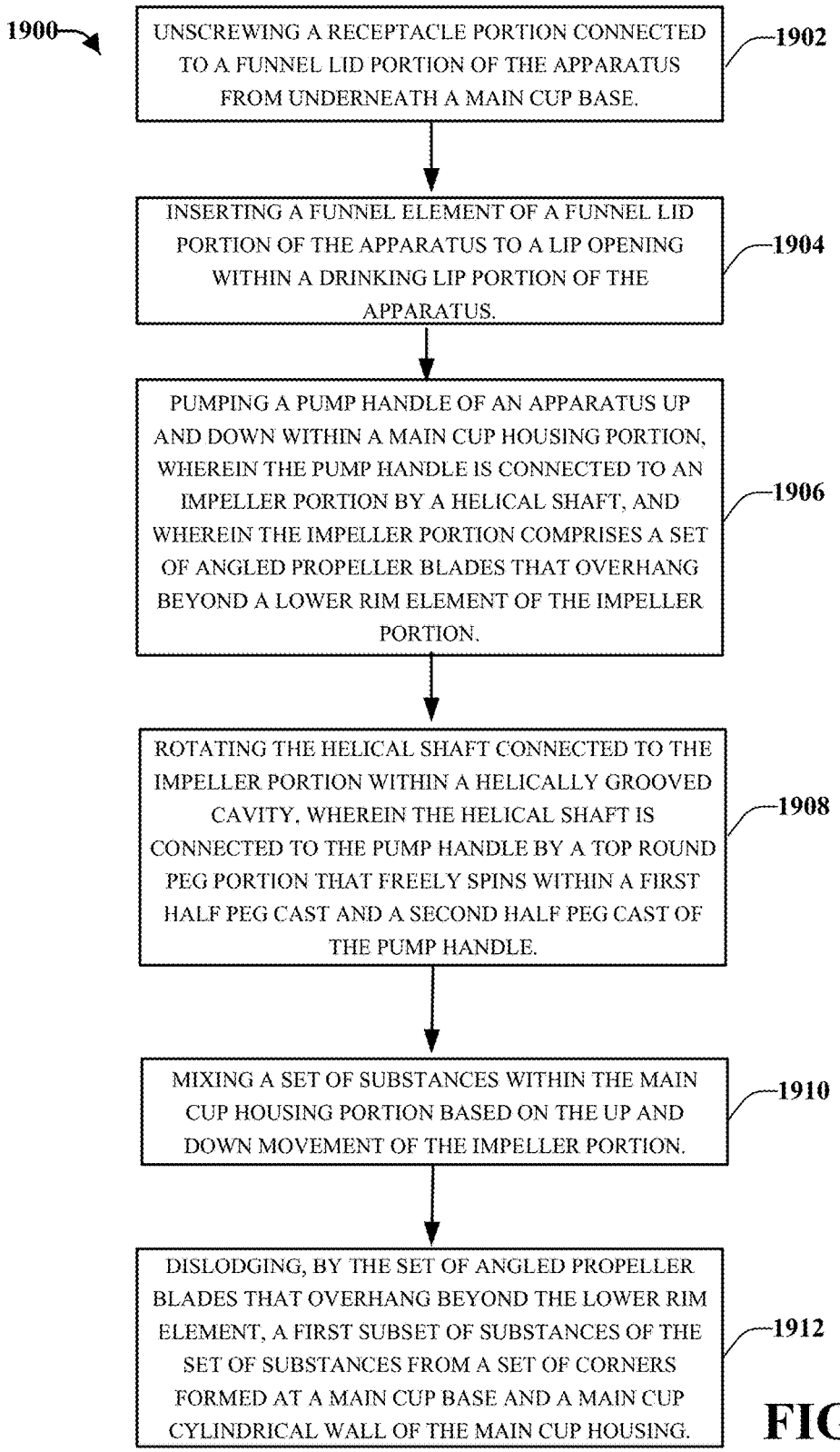
FIG. 19 illustrates a non-limiting high-level block diagram of an example method 1900 configured to store and mix substances in accordance with the subject application.

FIG. 19 provides an example method 1900 for storing and mixing substances in accordance with aspects and embodiments described herein. Repetitive description of like elements employed in system and methods disclosed herein is omitted for sake of brevity.

At 1902, a receptacle portion connected to a funnel lid portion of the apparatus is unscrewed from underneath a main cup base. At 1904, a funnel element of a funnel lid portion of the apparatus is inserted within a drinking lip portion of the apparatus. At 1906, a pump handle (e.g., using pump handle 28) of an apparatus is pumped up and down within a main cup housing portion (e.g., using main cup housing portion 5), wherein the pump handle (e.g., using pump handle 28) is connected to an impeller portion (e.g., using impeller portion 3) by a helical shaft (e.g., using helical shaft portion 4), and wherein the impeller portion comprises a set of angled propeller blades (e.g., using the set of propeller blades 23) that overhang (e.g., using overhang region 24) beyond a lower rim element of the impeller portion.

At 1908, the helical shaft connected to the impeller portion within a helically grooved cavity is rotated (e.g., using pump handle 28 to push and pull the helical shaft portion 4 up and down), wherein the helical shaft is connected to the pump handle by a top round peg portion that freely spins within a first half peg cast and a second half peg cast of the pump handle. At 1910, a set of substances are mixed (e.g., using impeller portion 3) within the main cup housing portion based on the up and down movement (e.g., using pump handle 28) of the impeller portion. At 1912, the set of angled propeller blades that overhang beyond the lower rim element dislodge (e.g., using the set of propeller blades 23 at the overhang region 24) a first subset of substances of the set of substances from a set of corners formed at a main cup base and a main cup cylindrical wall of the main cup housing.

In view of the exemplary systems described above, methodologies that may be implemented in accordance with the described subject matter will be better appreciated with reference to the flowcharts of the various figures. For simplicity of explanation, the methodologies are depicted and described as a series of acts. However, acts in accordance with this disclosure can occur in various orders and/or concurrently, and with other acts not presented and described in this disclosure. Furthermore, not all illustrated acts may be required to implement the methodologies in accordance with certain aspects of this disclosure. In addition, those skilled in the art will understand and appreciate that the methodologies could alternatively be represented as a series of interrelated states via a state diagram or events. Additionally, it should be appreciated that the methodologies disclosed in this disclosure are capable of being implemented in connection with an apparatus disclosed herein.

What is claimed is:

1. A method comprising:

storing a set of substances within a main cup housing portion of a mixer bottle apparatus, wherein the main cup housing portion comprises main cup base and a main cup top end, wherein the main cup housing portion is configured to contain a set of substances at a main cup opening located at the main cup top end;

storing a first subset of substances of the set of substances within a receptacle portion of the mixer bottle apparatus, wherein the receptacle portion is capable of interlocking to the main cup base, and wherein the receptacle portion comprises a funnel lid portion at a receptacle portion top end;

rotating an impeller portion of the mixer bottle apparatus downward or upward within the main cup housing portion, wherein a movement of the impeller portion downward or upward is capable of mixing the contained set of substances, wherein the impeller portion comprises a set of propeller blades, and wherein the impeller portion is connected to a helical shaft portion comprising a first helical strand and a second helical strand wound uniformly in a parallel spiral configuration; and interlocking a housing lid portion of the mixer bottle apparatus to the main cup top to enclose the main cup opening.

2. The method of claim 1, wherein the first subset of substances is a first liquid, a first gas, or a first powdered solid, and wherein a second subset of substances of the set of substances is a second liquid, a second gas, or a second solid contained within the main cup housing portion.

3. The method of claim 1, wherein the housing lid portion further comprises a drinking lid portion, a carrying clip portion, and a pump handle, wherein the drinking lid portion is capable of snapping into a lid opening within the drinking lid portion, wherein the carrying clip portion is capable of rotating within a first ring hinge and a second ring hinge corresponding to the carry clip portion, and wherein the pump handle comprises a first handle half and a second handle half snapped around a top round peg portion of the helical shaft.

4. The method of claim 3, wherein the first handle half comprises a first receiving cavity and a first clasping protrusion and the second handle half comprises a second receiving cavity and a second clasping protrusion, wherein the first clasping protrusion is configured to snap into the second receiving cavity, wherein the second clasping protrusion is configured to snap into the first receiving cavity, wherein the first handle half comprises a first peg cast and the second handle half comprises a second peg cast, and wherein the first peg cast and the second peg cast are configured to encapsulate the top round peg portion of the helical shaft.

5. The method of claim 1, wherein the receptacle portion of the mixer bottle apparatus further comprises a first receptacle screw threading and a second receptacle screw threading that circumscribe the receptacle portion top end.

6. The method of claim 1, wherein the funnel lid portion further comprises a gradient funnel wall connected to a funnel spout at a top funnel wall end and connected to a cylindrical base at a bottom funnel wall, wherein the gradient funnel wall comprises a first funnel tab and a second funnel tab capable of interlocking with the main cup base, and wherein the funnel spout is configured to fit into the lid opening.

7. The method of claim 6, wherein the main cup housing portion further comprises a main cup lip portion, a main cup threading, a overhanging cylindrical wall portion, a left receiving notch, and a right receiving notch, wherein the main cup lip portion is located near the main cup top end below the main cup threading that circumscribes the main cup above the main cup lip portion, wherein the overhanging cylindrical wall portion comprises the left receiving notch and the right receiving notch on a bottom rim of the cylindrical wall portion, and wherein the left receiving notch and the right receiving notch are configured to interlock with the first funnel tab.

8. The method of claim 1, wherein the impeller portion further comprises the set of propeller blades radiating outward from a central impeller opening configured to receive a bottom shaft end of the helical shaft, wherein the bottom shaft end comprises a first snapping prong and a second snapping prong configured to connect to the central impeller opening using a snapping mechanism, and wherein the set of propeller blades are sloping at an angle between a lower impeller rim and an upper impeller rim, and wherein the set of propeller blades overhang from the lower impeller rim.

9. The method of claim 1, wherein the housing lid portion comprises a left housing lid hinge hole, a right housing lid hinge hole, a helically grooved cavity, a drinking lip, a housing lid opening, and a set of housing lid threading, wherein the left housing lid hinge hole and the right housing lid hinge hole are configured to receive a right latch peg and a left latch peg associated with a carrying clip handle, wherein the helically grooved cavity is configured to circumscribe a helical stem portion of the helical shaft and facilitate the helical stem portion to move up and down within the helically grooved cavity, wherein the housing lid opening is capable of facilitating access to the set of substances within the main cup housing portion, and wherein the housing lid threading is located at a housing lid underside and facilitates the housing lid portion to interlock to the main cup top end via a screwing mechanism.

10. The method of claim 9, further comprising sealing a housing lid opening of the mixer bottle device, wherein the mixer bottle apparatus comprises a housing lid plug latch comprising a plug, the left latch peg, the right latch peg, a left latch groove, and a right latch groove, wherein the plug is capable of sealing the housing lid opening or exposing the housing lid opening to facilitate access to the set of substances within the main cup housing portion, wherein the left latch peg and the right latch peg are configured to snap into the left housing lid hinge hole and the right housing lid hinge hole, and wherein the left latch groove and the right latch groove are configured to receive a right clip peg and a left clip peg of the carrying clip handle.

* * * * *